US006860255B2

(12) United States Patent
Yamaguchi et al.

(10) Patent No.: US 6,860,255 B2
(45) Date of Patent: Mar. 1, 2005

(54) FUEL PUMP AND DIRECT FUEL INJECTION ENGINE

(75) Inventors: Shizuka Yamaguchi, Hitachinaka (JP); Noboru Baba, Hitachiota (JP); Toshiaki Nagayama, Urizura (JP); Katsuyoshi Terakado, Urizura (JP); Arata Kagiyama, Naka (JP); Hideki Machimura, Tokai (JP); Hiroyuki Yamada, Hitachinaka (JP); Yukio Takahashi, Hitachinaka (JP); Masayoshi Kotaki, Hitachinaka (JP); Kazuo Ojima, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/084,067

(22) Filed: Feb. 28, 2002

(65) Prior Publication Data

US 2003/0089343 A1 May 15, 2003

(30) Foreign Application Priority Data

Nov. 12, 2001 (JP) ..... 2001-345505

(51) Int. Cl.[7] ..... F02M 33/04
(52) U.S. Cl. ..... 123/495
(58) Field of Search ..... 123/495; 148/318, 148/319; 92/170

(56) References Cited

U.S. PATENT DOCUMENTS 4,486,247 A * 12/1984 Ecer et al. ..... 148/31.5
5,993,978 A * 11/1999 Kim et al. ..... 428/553
6,090,225 A * 7/2000 Pichard ..... 148/319
6,149,734 A * 11/2000 Isogai et al. ..... 148/233
6,526,949 B2 * 3/2003 Murakami et al. ..... 123/506
2002/0066502 A1 * 6/2002 Tako et al. ..... 148/318

FOREIGN PATENT DOCUMENTS

| | | |
|---|---|---|
| DE | 10039169 | 3/2001 |
| EP | 0787621 | 11/1998 |
| JP | 7-216548 | 8/1995 |
| JP | 07-216548 | 8/1995 |
| JP | 9-236080 | 9/1997 |
| JP | 09-236080 | 9/1997 |
| JP | 10-318091 | 12/1998 |

OTHER PUBLICATIONS

Encyclopedia of materials science and engineering vol. 4, Pergamon Press, 1986; pp. 520–522, 3210–3213.*

* cited by examiner

*Primary Examiner*—Thomas Moulis
(74) *Attorney, Agent, or Firm*—Crowell & Moring LLP

(57) ABSTRACT

A fuel pump, of which sliding mechanism parts in its fuel chamber have good wear resistance under a severe environment, and a direct fuel injection engine using the fuel pump are provided.

In a fuel pump for pressurizing and delivering fuel to a fuel injector of a vehicle engine, at least one of sliding surfaces of a slant plate, a slipper and a plunger sliding in a lubricating oil and at least one of sliding surfaces of sliding members of a plunger and a cylinder contacting with and sliding on each other through the fuel are formed of a hardened layer composed of any one of a nitrided layer, a carburization quenched layer and a carbonitrided layer, or coated with a high corrosion resistant and hard metal compound layer over the hardened layer.

21 Claims, 19 Drawing Sheets

WEARING TEST RESULTS OF MATERIAL SKD11 AND VARIOUS KINDS OF SURFACE-TREATED MATERIALS (1/2)

(a) SPECIFIC WEAR (b) FRICTION COEFFICIENT

WEARING TEST RESULTS OF MATERIAL SKD11 AND VARIOUS KINDS OF SURFACE-TREATED MATERIALS (2/2)

FUEL PUMP AND DIRECT FUEL INJECTION ENGINE

BACKGROUND OF THE INVENTION

This application claims the priority of Application No. 2001-345505, filed Nov. 12, 2001, in, the disclosure of which is expressly incorporated by reference herein.

The present invention relates to a fuel pump for supplying fuel in an internal combustion engine and a direct fuel injection engine, and particularly to a fuel pump used for a high pressure pump of a fuel injector for a direct fuel injection engine of a vehicle in which fuel is directly injected into a combustion chamber from the fuel injector attached to the combustion chamber of the vehicle engine, and to the direct fuel injection engine.

In general, an in-cylinder direct fuel injection device requires a high pressure pump capable of supplying gasoline into cylinders of an internal combustion engine with a high pressure above 3 MPa because it is necessary to directly inject gasoline into the cylinders even at the compression stroke.

One type of the high pressure pumps is a radial plunger high pressure fuel pump. A high pressure fuel pump of this type is disclosed, for example, in Japanese Patent Application Laid-Open No. 10-318091.

Another type of the high pressure pump is a slant-plate axial plunger pump in which a rotating motion of a slant plate rotated by a shaft inside a housing is converted to an oscillating motion by an oscillating plate, and fluid is sucked and pressurized to be delivered at a high pressure by a plunger reciprocally moved by the oscillating motion of the oscillating plate. The slant-plate axial plunger pump is disclosed, for example, in Japanese Patent Application Laid-Open No. 9-236080.

In the fuel pumps having these structures, fuel is sucked and delivered by the motion of a reciprocally moving piston or pistons inside a fuel chamber of a mechanism portion generating a high pressure, and thereby the fuel is pressurized to a high pressure. Accordingly, fluid existing in the fuel chamber is only the fuel of gasoline. Therefore, the gasoline acts as a lubricating oil at a sliding portion in each mechanism. Further, at a potion other than the fuel chamber, sliding in various kinds of the mechanisms converting the rotating motion to the reciprocal motion is performed using a lubricating oil under condition of a high speed (high peripheral speed) and high surface pressing pressure.

As for the wear-resistant sliding members, Japanese Patent Application Laid-Open No. 7-216548 discloses, for example, a wear-resistant sliding member of a fuel injection nozzle device in which a nitride film is formed by plasma nitriding treatment at a portion in the fuel injection nozzle relatively contacting to or sliding on another member, and a TiCN film is further formed by plasma CVD on the nitride film.

The surface treated layer of the prior art will be described below. It is described that a method of forming the film is plasma CVD, and the material of the hard film is a TiCN film. Further, in regard to thickness of the surface treated layer, the nitride film is 5 to 20 $\mu$m thickness, and the TiCN is 2 to 10 $\mu$m thickness. Accordingly, the range of the thickness of the surface treated layer becomes 7 $\mu$m at minimum and 30 $\mu$m at maximum. Since the film is generally formed under a pressure of several Pa by the plasma CVD, the plasma CVD method is better than the PVD method in treatment of a narrow portion due to the mean free path (traveling distance of a particle in a gas atmosphere without collision), but the difficulty of treatment is nearly equal to each other. On the other hand, since chlorine of a component of a feed gas is mixed into the film, there is a problem in that the film properties such as corrosion resistance, wear resistance, hardness and the like are degraded.

The TiCN film has a property of combining the properties of TiN and TiC which compensate individual problems each other. The hardness of the film is within a range of Hv 2500 to 3000, but the friction coefficient is generally as high as 0.6. On the other hand, the friction coefficient of carbon group films (DLC) is a very low value below 0.1. Forming of the nitride film ① makes the surface roughness of the TiCN film fine. It is described that a purpose of increasing the hardness of the base material is ② to improve the ability of preventing the TiCN film from peeling. However, it is not described on the reason why the thickness of the TiCN film is set to 5 to 20 $\mu$m. It is described that the effect of the TiCN film as a wear resistant film is insufficient when the thickness is thinner than 2 $\mu$m, and a bad influence due to internal stress of the TiCN film occurs when the thickness is thicker than 10 $\mu$m. On the other hand, the carbon group film (DLC) has an excellent wear resistance even when the thickness is 0.5 to 1.5 $\mu$m.

In recent years, it is desired to apply an in-cylinder direct fuel injection device to the combustion engine, particularly, to the gasoline engine for vehicle in order to improve the fuel consumption characteristic, to reduce the amount of harmful exhaust gas and to improve the driving response such as an acceleration performance.

In the fuel pump of the in-cylinder direct fuel injection device, the sliding portions in the pump portion (pressurizing portion) inside the fuel chamber slide on each other under a high surface pressing pressure condition in the fuel (gasoline). Therefore, the portions are considered to be main wearing portions because the portions slide on and contact with each other under a high surface pressing pressure.

In the mechanism portion in the pump portion inside the fuel chamber such as the plunger and the cylinder for pressurizing fuel (gasoline), the sliding between the plunger and the cylinder is performed in the fuel. When gasoline is used as the lubricating oil of the sliding environment, both of the sliding surfaces of the sliding mechanism portions are easily worn because the viscosity of gasoline is extremely small compared to the viscosity of a normal lubricating oil.

In addition, gasoline added with methyl alcohol or methyl alcohol, or degraded gasoline is sometimes used as the fuel. The gasoline of such kind sometimes forms an oxidizing wearing environment. In such a case, the environment to wearing of the contact portions of the sliding mechanism portion becomes severer, and accordingly the wearing amount of the sliding portions is considered to be increased.

When the sliding mechanism portion in the fuel chamber, that is, the contact portions between the cylinder and the plunger reciprocally moving in the cylinder are worn to increase the wearing amount, the suction and delivery efficiency may be decreased, and the reliability may be also decreased.

On the other hand, in the radial plunger pump, a driving cam rotationally moved at a high speed by a transmitted driving force of the engine and a lifter for converting the rotational motion to reciprocal motion slide on each other under an environment of insufficient supply of a lubricating oil (engine oil). Therefore, the seizing resistance and the wear resistance of the driving cam and the lifter from a low speed range to a high speed range are required.

Further, in the rotating slant plate axial plunger pump, the slant plate and the slipper for converting rotation of the shaft to reciprocal motion slide on each other in a lubricating oil (engine oil). Although the sliding is performed in the lubricating oil (engine oil), severe requirement for the properties of the materials may be required depending on the condition of sliding. That is, the seizing resistance and the wear resistance of the members from a low speed range to a high speed range are required.

In other words, there is a problem in that occurrence of abnormal wearing, that is, seizing in the slant plate and the slipper or the driving cam and the lifter of the sliding mechanism portion causes stopping of operation of the fuel pump.

Therefore, each part in the sliding mechanism portion is required durability, particularly, wear resistance and corrosion resistance in fuel having less lubricity, or in a fuel containing an oxidative component, or further in a lubricating oil such as engine oil.

In Japanese Patent Application Laid-Open No. 8-35075, there is description that an ion nitride layer is formed, and a hard layer composed of a nitride, a carbide or a carbonitride of at least one kind selected from the group consisting of Ti, Zr, Hf, V, Nb, Ta and Cr is formed on the ion nitride layer through a PVD method. It is disclosed to apply it to a metal mold in order to improve the adhering property and the durability. However, the seizing resistance, the wear resistance and the corrosion resistance under a high temperature and high surface pressing pressure condition are not discussed.

SUMMARY OF THE INVENTION

An object of the present invention is to provide a fuel pump of which the sliding mechanism parts inside the fuel chamber have a good seizing resistance, a good wear resistance and a good corrosion resistance in a lubricating oil (engine oil), or in a fuel having a less lubricity, or further in a fuel containing a oxidative component, and to provide an direct fuel injection engine using the fuel pump.

In order to attain the above-described object, one of the features of a fuel pump in accordance with the present invention is that in a fuel pump pressurizing fuel to supply the fuel to a fuel injector of a vehicle engine, films having corrosion resistance and wearing resistance are formed individually on surfaces of members contacting with and sliding on each other.

Further, another feature of a fuel pump in accordance with the present invention is that members contacting with and sliding on each other in a lubricating oil are made of a wearing resistant material having good seizing resistance, wearing resistance and corrosion resistance, and members sliding by receiving a load among the surfaces of the members contacting with and sliding on each other are made of an iron group sintered material, and are individually coated with an oxide film on the surface or treated with surface treatment to increase the surface hardness of the member itself or are coated with a film having corrosion resistance and wearing resistance.

Further, the present invention is characterized by a fuel pump for pressurizing fuel to deliver the fuel to a fuel injector of a vehicle engine, which comprises a hardened layer composed of at least one layer selected from the group consisting of a nitrided layer, a carburization-quenched layer and a carbonitrided layer on at least one of sliding surfaces which contact with and slide on each other through the fuel or lubricating oil; and a carbon group film having a hardness higher than a hardness of the hardened layer on a surface of the hardened layer.

Further, the present invention is characterized by a fuel pump for pressurizing fuel to deliver the fuel to a fuel injector of a vehicle engine, which comprises a hardened layer composed of at least one layer selected from the group consisting of a nitrided layer, a carburization-quenched layer and a carbonitrided layer on one of sliding surfaces which contact with and slide on each other through said fuel or lubricating oil; a hardened layer composed of at least one layer selected from the group consisting of a nitrided layer, a carburization-quenched layer and a carbonitrided layer on the other sliding surface opposite to the one of the sliding surfaces; and a carbon group film having a hardness higher than a hardness of the hardened layer on each of surfaces of said hardened layers of the one sliding surface and the other sliding surface.

Further, the present invention is characterized by a fuel pump for pressurizing fuel to deliver the fuel to a fuel injector of a vehicle engine, which comprises a hardened layer composed of at least one layer selected from the group consisting of a nitrided layer, a carburization-quenched layer and a carbonitrided layer on sliding surfaces which contact with and slide on each other through the fuel or lubricating oil; and a carbon group film having a hardness higher than a hardness of the hardened layer on the surfaces of the hardened layers.

Further, the present invention is characterized by a fuel pump comprising a shaft rotated by driving of a vehicle engine; a cam rotated by the rotation of said shaft; and a plunger reciprocally moved in a cylinder by the rotation motion of the cam through a lifter, the fuel pump pressurizing fuel to deliver the fuel to a fuel injector of the vehicle engine, which comprises a hardened layer composed of at least one layer selected from the group consisting of a nitrided layer, a carburization-quenched layer and a carbonitrided layer on at least one of sliding surfaces of the plunger and the cylinder which contact with and slide on each other; and a carbon group film having a corrosion resistance to the fuel higher than a corrosion resistance of the hardened layer, the carbon group film being formed on a surface of the hardened layer.

Further, the present invention is characterized by a fuel pump comprising a shaft rotated by driving of a vehicle engine; a cam rotated by the rotation of the shaft; and a plunger reciprocally moved in a cylinder by the rotation motion of the cam through a lifter, the fuel pump pressurizing fuel to deliver the fuel to a fuel injector of the vehicle engine, which comprises a hardened layer composed of at least one layer selected from the group consisting of a nitrided layer, a carburization-quenched layer and a carbonitrided layer on a sliding surface of the lifter contacting with and sliding on the cam through lubricating oil; and a carbon group film having a hardness higher than a hardness of the hardened layer, the carbon group film being formed on a surface of the hardened layer.

Further, the present invention is characterized by a fuel pump comprising in its housing a shaft for transmitting rotation from outside; a slant plate for converting the rotation of the shaft to oscillating motion; and a plunger for converting the oscillating motion of the slant plate to reciprocal motion in a cylinder through a slipper, wherein the slipper is made of an iron group sintered material, and an oxide layer is formed on a surface of the slipper.

Further, the present invention is characterized by the pump described above, wherein a hardened layer composed of at least one layer selected from the group consisting of a nitrided layer, a carburization-quenched layer and a carbonitrided layer is formed on an outer peripheral surface of the plunger and on an inner peripheral surface of the cylinder, and a carbon group film or a metal compound having high corrosion resistance and high hardness is formed on the outer peripheral surface of the plunger.

Further, the present invention is characterized by a fuel pump for pressurizing fuel to deliver the fuel to a fuel injector of a vehicle engine, which comprises a hardened layer composed of at least one layer selected from the group consisting of a nitrided layer, a carburization-quenched layer and a carbonitrided layer on an inner peripheral surface of a cylinder to serve as a sliding surface of one member; and a carbon film or a metal compound layer on an outer peripheral surface to serve as a sliding surface of the other member, the sliding surfaces contacting with and sliding on each other through lubricating oil or the fuel, wherein another member sliding on an end surface of the other member described above is formed of an iron group sintered material, ad an oxide layer is formed on a surface of the another member.

Further, the present invention is characterized by a direct fuel injection engine comprising a fuel injection means which directly injects fuel into a combustion chamber, preferably injects the fuel according to lean-burn control of an air-fuel ratio above 45; and a fuel pump for delivering the fuel to the fuel injection means, wherein the fuel pump is any one of the fuel pumps described above.

Further, it is preferable that the slipper member in the present invention is made of an iron group sintered material treated with carburization quenching or an iron group sintered material coated with an oxide film having a major component of $Fe_3O_4$ formed by steam treatment at 500 to 600° C. It is preferable that the iron group sintered material is an Fe alloy containing C of 0.2 to 0.8%, or C of 0.2 to 1.0% and Cu of 1 to 5%, or C of 0.2 to 0.8%, Cu of 0.5 to 3% and Ni of 1 to 8% in weight basis, and has a little amount of pores. The lubricity of the iron group sintered material can be increased by impregnating the pores with a lubricating oil.

Further, it is preferable that the slant plate in the present invention is made of a casting iron, a mechanical-structural alloy steel, an alloy tool steel, a heat-treated martensitic stainless steel or a surface treated material of any one of the above-mentioned materials.

Further, it is preferable that after surface treatment, the hardened layer of the present invention is treated to eliminate weak compounds by being heated up to a temperature equal to or higher than a temperature of the surface treatment. The diffusion surface treatment is performed to a nitrided layer, a carbonitrided layer, a soft nitrided layer, a salt bath soft nitrided layer, a carburization quenched layer or a composite layer of the above layers. It is preferable that $Fe_3N$ (white chemical compound layer) is not formed in the nitrided layer of the diffusion surface treated layer. It is preferable that the nitrided layer as the nitrided layer of the cylinder is formed at a treatment temperature below 450° C.

Further, a carbon group film or a metal compound layer is used as the corrosion resistant and wear resistant film in accordance with the present invention. A metal compound selected from the group consisting of carbide, nitride, carbonitride is used for the latter, and each of them can be formed through CVD or ion-plating. Since the carbon group film and the metal compound layer are high in hardness and small in wear, and further chemically stable, reactivity of the material with a material of the other side sliding member. Therefore, the corrosion resistance and the wear resistance are substantially improved. In addition, since the carbon group film shows a good sliding performance because of a small friction coefficient. On the other hand, it is preferable that as the carbon group film, a diamond-shaped or diamond-like film (DLC), a metal containing diamond-like film (Me-DVC), or a laminated film of WC and C (WC/C) is used.

Further, it is desirable that as the sliding members contacting with and sliding on each other in accordance with the present invention, a martensitic stainless steel, an alloy steel or a bearing steel is used. The cylinder in the present invention has one or plural (three) holes in each block, and is preferably made of an alloy tool steel containing C of 0.25 to 0.5% (preferably, 0.3 to 0.45%), or C of 1 to 2% (preferably, 1.3 to 1.6%), an alloy tool steel containing Cr of 5 to 13% (preferably, 6.5 to 8.5%), Mo less than 2% (preferably 0.7 to 1.5%) and V less than 1% (preferably, 0.1 to 0.6%), or a martensitic stainless steel. It is preferable that the nitrided layer serving as the hardened layer is preferably formed through the salt bath treatment at a treated temperature of 350 to 500° C. so that the thickness of the hardened layer becomes 20 to 40 $\mu$m. On the other hand, it is preferable that the plunger is made of an alloy tool steel containing C of 1 to 2% (preferably, 1.3 to 1.6%), Cr of 10 to 113.5% (preferably, 11 to 13%), Mo less than 2% (preferably, 0.7 to 1.5%) and V less than 1% (preferably, 0.1 to 0.6%), or a martensitic stainless steel. It is preferable that the nitrided layer serving as the hardened layer is preferably formed through the ion nitriding treatment at a treated temperature of 350 to 600° C. so that the thickness of the hardened layer becomes 70 to 130 $\mu$m.

Further, when the sliding mechanism parts inside the fuel pump chamber are sliding on each other in a lubricating oil (engine oil) or the fuel (gasoline), the material, the surface treatment and the combination of each of the sliding parts are optimally set. In regard to each of the sliding parts in the lubricating oil (engine oil), the seizing resistance under high sliding speed (high peripheral speed) is particularly taken into consideration, and the material specification is selected so as to have a structure capable of obtaining such a characteristic.

Further, in regard to each of the sliding parts in the fuel (gasoline), the wearing resistance is improved by performing the surface treatment.

A diffusion surface treated layer or a corrosion-resistant and wearing-resistant hardened film is formed as the surface treated layer. In regard to the diffusion surface treated layer, as the nitriding group layers increasing the hardness by diffusing mainly nitrogen to precipitate fine grain nitrates there are the nitrided layer, the carbonitrided layer, the soft nitrided layer and the salt-bath nitrided layer. Further, the carburization treatment for obtaining high hardness by diffusing carbon at a high temperature range and then performing quench-heat treatment may be also employed. In the nitriding group layer, nitride producing elements are formed into nitrides to increase the hardness higher than the base material, and to make the property difficult to be seized, and to improve the resistances of the base material against friction and wear. Further, the nitrided layer has a property hardly to be separated even under a high surface pressing pressure because the nitrided layer is a treated layer continuing to the base material. The carbonitrided layer can be formed in a deep layer, and accordingly, has a good withstanding performance when it receives a high surface pressing pressure.

Further, the diffusion surface treated layer is formed as a base layer for forming the highly hard carbon group film or metal compound layer having corrosion resistance and wear resistance. By forming the diffusion surface treated layer, the hardness of the base material can be increased to improve the load withstanding property against a high surface pressing pressure and also to improve the separation resistance of the hard film.

By the structure described above, the friction coefficient becomes small, and adhering or sticking of one material to the other material hardly occurs. Therefore, occurrence of initial wearing, normal wearing and seizing can be prevented. Thereby, a fuel pump having high reliability can be provided. The above-mentioned features and the other features of the present invention will be further described below in detail.

Other objects, advantages and novel features of the present invention will become apparent from the following detailed description of the invention when considered in conjunction with the accompanying drawings.

DETAILED DESCRIPTION OF THE PREFERRED EMBODIMENTS

Embodiment 1

The present embodiment relates to a radial plunger fuel pump (single cylinder type). The radial plunger fuel pump comprises a shaft for transmitting a driving force of an engine; a driving cam for converting rotation motion of the shaft to oscillation motion; a plunger for converting the rotation motion of the driving cam to reciprocal motion inside cylinder through a slipper; and a cylinder bore combined with the plunger to suck and deliver fuel, wherein a nitrided layer, a carburization quenched layer or a carburization quenched layer coated with a highly hard carbon group film is formed on at least one of surfaces of the above-described mechanism portions sliding by being lubricated by fuel and members of pump portions.

Figure 1:
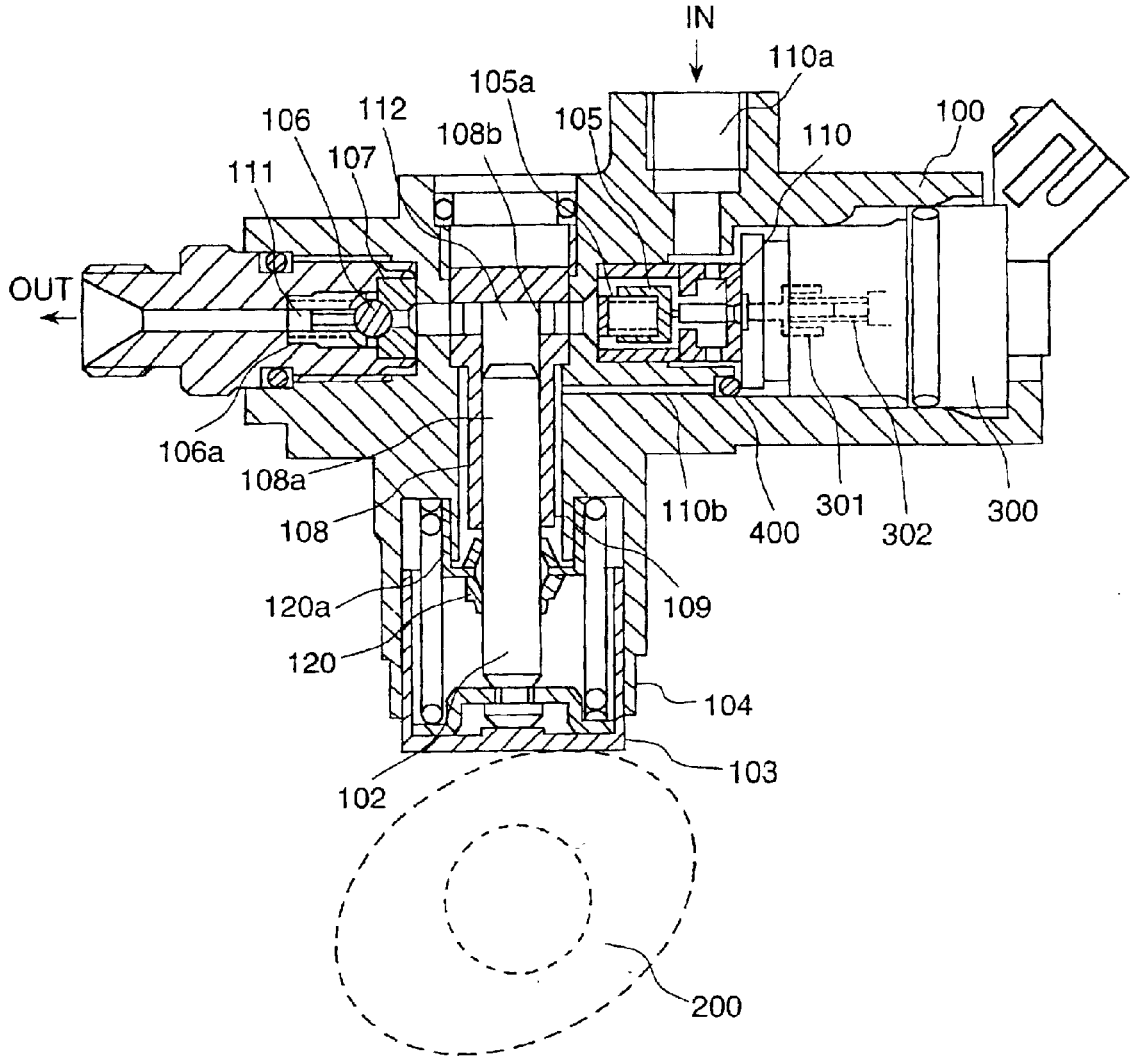
FIG. 1 is a cross-sectional view showing a part of a first embodiment of a fuel pump in accordance with the present invention.
Figure 2:
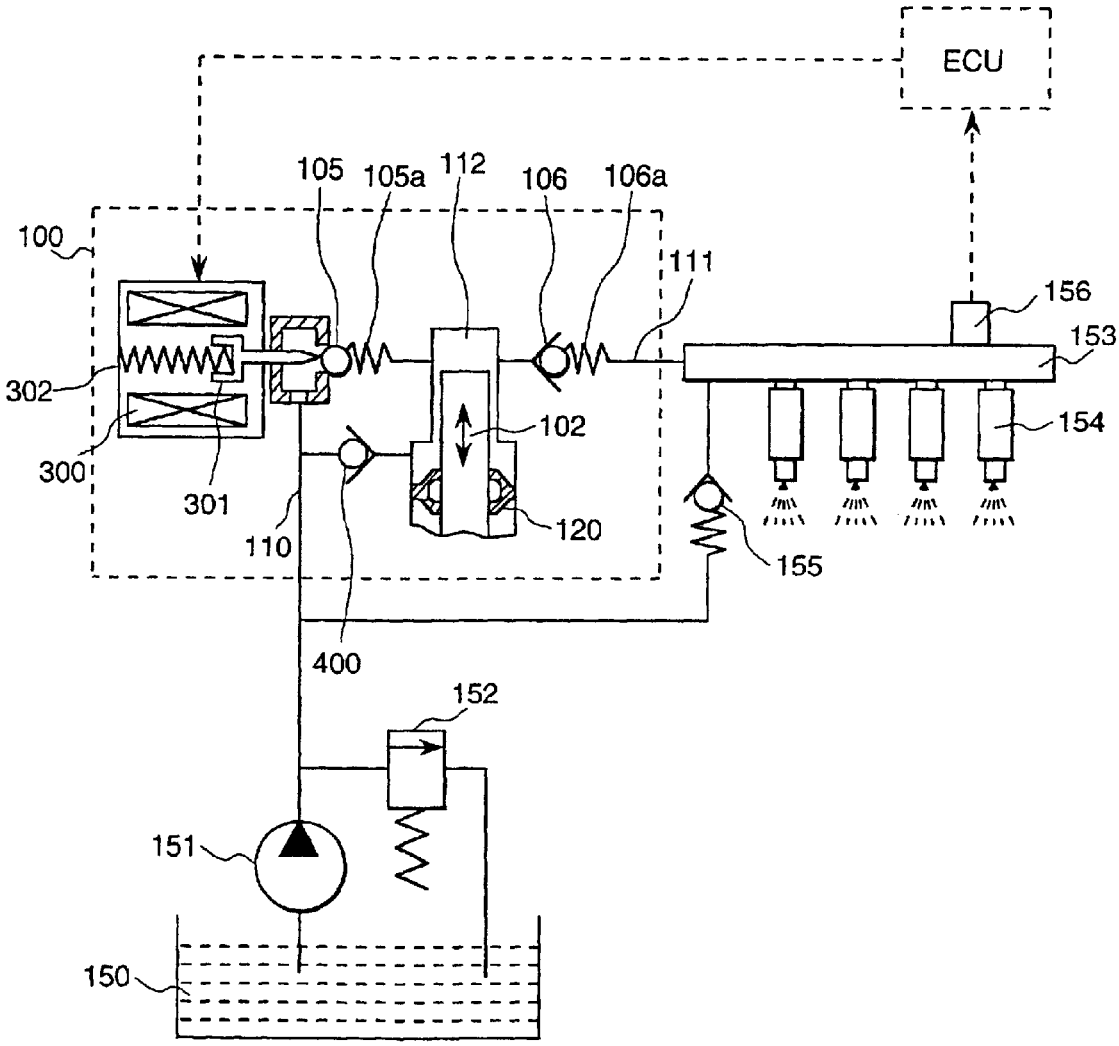
FIG. 2 is a diagram showing the system construction of the first embodiment of the fuel injection system in accordance with the present invention.

FIG. 1 and FIG. 2 show the details of the radial plunger pump in accordance with the present embodiment. FIG. 1 is a vertical cross-sectional view, and FIG. 2 is a diagram showing the construction of a fuel injection system using the present embodiment.

A pump main body 100 comprises a fuel suction passage 110, a delivery passage 111 and a pressurizing chamber 112. A suction valve 105 and a delivery valve 106 are provided in the fuel suction passage 110 and the delivery passage 111, and are held in one direction by springs 105*a* and 106*a* to serve as check valves for limiting flowing direction of the fuel, respectively.

There, a plunger 102 of a pressurizing member is slidably held in the pressurizing chamber 112. A lifter 103 arranged in the bottom end of the plunger 102 is pushed to a cam 200 by a spring 104. The plunger 102 is reciprocally moved by the cam 200 rotated by the engine cam shaft and so on to change the volume inside the pressurizing chamber 112. When the suction valve 105 is closed during the compression stroke of the plunger 102, the pressure inside the pressurizing chamber 112 is increased. Thereby, the delivery valve 106 automatically opens to pressurize and deliver the fuel to a common-rail 153. Although the suction valve 105 automatically opens when the pressure of the pressurizing chamber 112 becomes lower than the pressure at the fuel inlet port, closing of the suction valve 105 is determined by operation of a solenoid 300.

The solenoid 300 is attached to the pump main body 100. A coupling member 301 and a spring 302 are arranged in the solenoid 300. A force is applied to the coupling member 301 in a direction to open the suction valve 105 by the spring 302 when the solenoid 300 is in an OFF state. Since the applied force of the spring 302 is larger than the applied force of the spring 105 of the suction valve, the suction valve 105 is in an open state when the solenoid is in the OFF state, as shown in FIG. 1.

When the high pressure fuel is supplied from the pump main body 100, the solenoid 300 is brought to the ON (energized) state. When the fuel supply is stopped, current to the solenoid 300 is limited so that the solenoid 300 is brought to the OFF (de-energized) state.

While the solenoid 300 is being held in the ON (energized) state, a magnet force larger than the applying force of the spring 302 is generated to attract the coupling member 301 toward the solenoid 300 side. Therefore, the coupling member 301 is separated from the suction valve 105. In the condition described above, the suction valve 105 becomes an automatic valve opening and closing in synchronism with the reciprocal motion of the plunger 102. Accordingly, the suction valve 105 is closed during the compression stroke, and the fuel corresponding to the reduced volume of the pressurizing chamber 112 is pressurized and delivered to the common-rail 153 by pushing to open the delivery valve 106.

On the other hand, when the solenoid 300 is being held in the OFF (de-energized) state, the coupling member 301 is coupled with the suction valve 105 by the applying force of the spring 302 to hold the suction valve 105 in the opening state. Therefore, since the pressure of the pressurizing chamber 112 is held at a low pressure state nearly equal to the pressure at the fuel inlet port portion even in the compression stroke, the delivery valve 106 can not be opened, and accordingly the fuel corresponding to the reduced volume of the pressurizing chamber is returned to the fuel inlet port side through the suction valve 105.

Further, when the solenoid 300 is brought in the ON state during the compression stroke, the fuel is started to be pressurized and delivered to the common-rail 153 on the instant. Further, once the fuel is started to be pressurized and delivered, the suction valve 105 keeps the closed state even if the solenoid 300 is brought to the OFF state after starting of the fuel delivery because the pressure inside the pressurizing chamber 112 is increased.

The system construction of the fuel supply system using the present embodiment will be described below, referring to FIG. 2.

Fuel in a tank 150 is guided to the fuel inlet port of the pump main body 100 by a low pressure pump 151 and being regulated to a constant pressure by a pressure regulator 152. Then, the fuel is pressurized by the pump main body 100 to be pressurized and delivered to the common-rail 153 through the fuel delivery port. Injectors 154, a relief valve 155 and a pressure sensor 156 are arranged in the common-rail 153. Number of the mounted injectors 154 corresponds to number of cylinders of the engine, and the injector 154 injects fuel into the cylinder according to a signal from an engine control unit (ECU). Further, the relief valve 155 prevents the piping from being damaged by being opened when the pressure in the common-rail exceeds a preset value.

In the radial plunger fuel pump as described above, main members required to be corrosion-resistant and wear-resistant among members operated in the fuel are the plunger of the pressurizing member of the pimp chamber and a cylinder bore having a sliding bore for reciprocally slidably supporting the plunger. Particularly, the radial gap between the plunger and the cylinder bore is designed to be smaller than 10 $\mu$m in order to minimize leakage of the fuel from the pressurizing chamber. Therefore, the pump performance will be degraded if the radial gap is increased by wearing.

Further, corrosion resistance and wear resistance are also required for the plunger in a sliding portion with a shaft seal for sealing between the fuel and oil. Wearing in the sliding portion is undesirable because the oil is diluted to decrease the lubricating performance and the fuel economy is degraded if the oil leaks into the fuel.

The compositions of materials for the plunger and the cylinder block are selected as follows. Since the outer periphery of the plunger initially slides on the cylinder bore in a line-contact state, the surface pressing pressure (Hertz stress) becomes large. Therefore, the materials are preferably of high hardness. A martensitic stainless steel such as a material type SUS 440C or a material type SUS420J2 is quenched and tempered to be used for the cylinder block. The martensitic stain less steel has a good productivity because a product shape is obtainable through pressing work. An alloy tool steel (a material type SKD61, a material type SKD11 or the like) or a bearing steel may be quenched and tempered to be used for the cylinder block.

The hardness of the materials type SUS440C and SUS420J2 become Hv 500 to 700 by quenching and tempering. Further, these materials have good corrosion resistance because of stainless steel.

The same can be said for the material for the plunger. However, the plunger is used under a surface pressing pressure higher than that of the cylinder block, surface treatment is performed to the material of the plunger in order to obtain the wear resistance by further increasing its hardness.

Figures 3A, 3B, 3C:
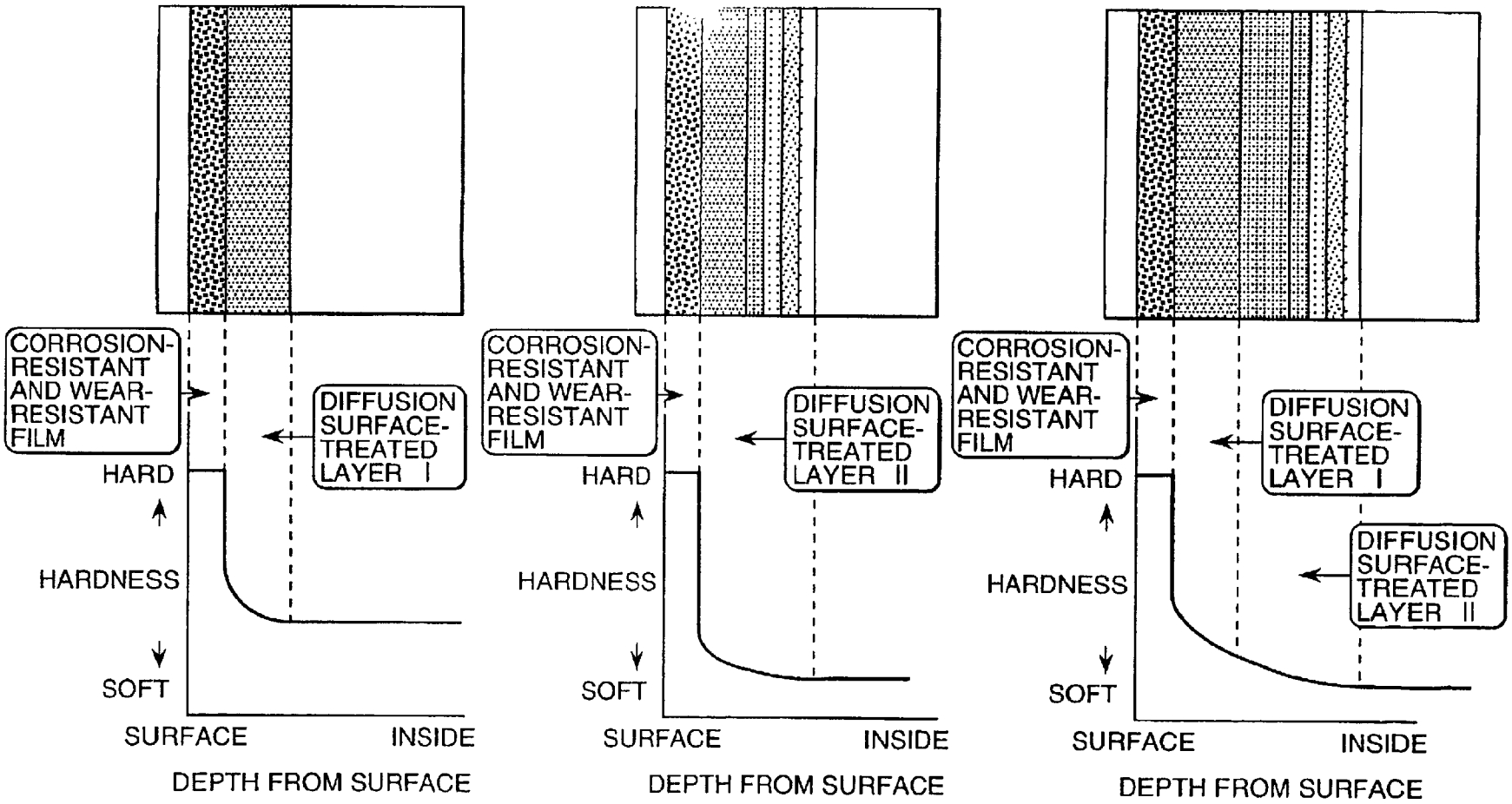
FIG. 3 is an illustration explaining the structures of surface treated layers in the first embodiments in accordance with the present invention.

FIG. 3 shows surface structures in accordance with the present invention. Each of the surface structures is formed in a complex surface treated layer which is obtained by forming a diffusion surface treated layer of a nitrided layer, a carburetion quenched layer or a carbonitrided layer in the base material, and then coating the surface with a highly hard carbon group film having corrosion resistance and wear resistance.

The surface structure of FIG. 3(*a*) is comprised of the carbon group film and a diffusion surface treated layer I. The surface structure of FIG. 3(*b*) is composed of the carbon group film and a diffusion surface treated layer II.

The diffusion surface layer I is a nitriding group layer in which the hardness is increased by diffusing mainly nitrogen through treatment in a low temperature range not deteriorating the property of the base material to precipitate fine nitride grains, and as the nitriding group layers there are a nitrided layer, a carbonitrided layer, a soft nitrided layer and a salt bath soft nitrided layer. A hard surface layer having a surface hardness above Hv 1000 can be easily formed, but the thickness of the treated layer is comparatively thin. Further, the nitriding group layer has a property of hardly sticking, and accordingly the reactivity against friction and wearing of the material can be improved.

The diffusion surface layer II is a carburizing group layer in which the high hardness is obtained by diffusing carbon in a high temperature range and then performing quenching heat treatment. The diffusion surface treated layer II is a hardened layer deeper than the depth of the diffusion surface treated layer I, and accordingly has a good load withstanding performance at receiving high surface pressing pressure.

Each of these diffusion surface treated layer has a property of hardly separating even under a high surface pressing pressure because a treated layer continuing to the base material. Further, by increasing the hardness of the base material and coating the corrosion resistant and wear resistant hard film, there are effects in that the load withstanding performance against high surface pressing pressure can be improved, and at the same time, in that the separation resistance of the hard film can be improved.

In order to satisfy the above-described target properties, the structure and the surface form of the diffusion surface treated layer I to be serving as the base of the corrosion resistant and wear resistant hard layer are important. That is, it is necessary that the surface of the nitrided layer does not have such structure and form as to deteriorate the separation resistance of the hard film.

An ion nitriding method is that an article to be treated is placed in a cathode side in a depressurized container (an anode), and after introducing nitrogen process gas ($N_2$) and a diluting gas ($H_2$) into the depressurized container, direct current discharge (glow discharge) is generated by applying a high direct current voltage between the anode and the cathode to diffuse nitrogen atoms ionized by the direct current plasma into the inside of the article.

According to a general ion nitriding treatment, a brittle ϵ-phase (Fe2N, Fe3N) called as a white compound layer of Fe nitride is formed on the uppermost surface portion. As a method of removing the brittle white compound, nitriding treatment and diffusion treatment are also applicable. In that case, hardness of the nitrided layer can be controlled.

Figure 4A:
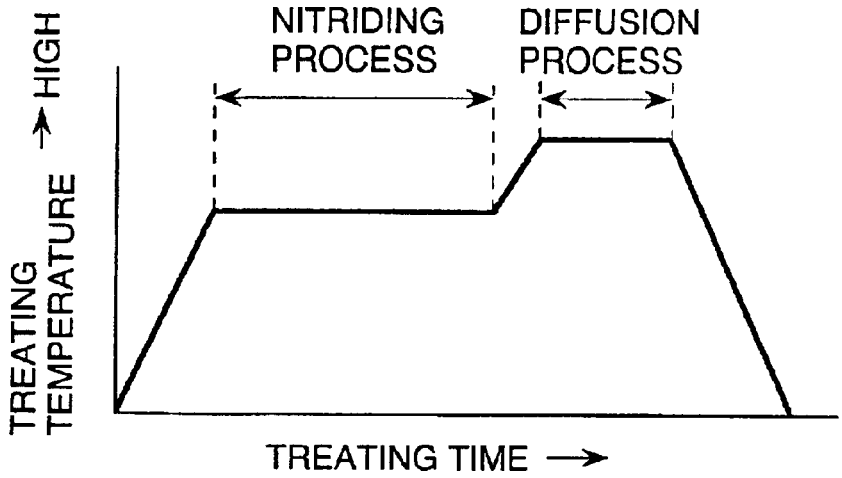
FIG. 4 is graphs showing the treatment processes of forming the nitride layer in the first embodiment in accordance with the present invention.
Figure 4B:
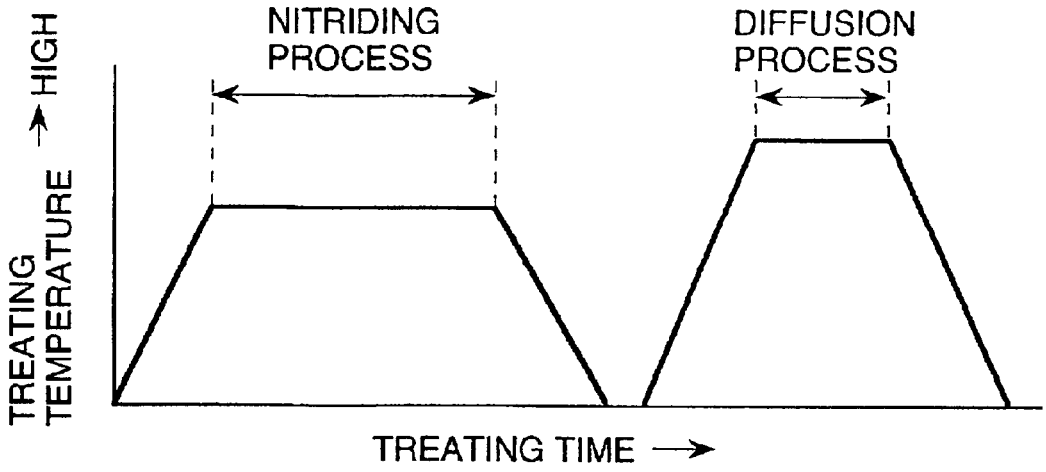

FIG. 4 is graphs showing the treatment processes of controlling hardness of the nitrided layer used in the embodiment in accordance with the present invention. In this case, the gas nitriding method is applicable to the nitriding treatment during the treatment process. However, the ion nitriding method (the plasma nitriding method) capable of widely controlling the compound of the surface layer by varying the gas composition is more suitable.

The treatment process (a) shown in the figure is a process in which the nitriding treatment and the diffusion process are continuously performed. In the ion nitriding treating method, the depressurized container is cooled, and the temperature of the article to be treated can be arbitrarily raised up and maintained by the input electric power (discharge electric power). Further, the treatment process (a) has an advantage in that the atmosphere can be changed from the nitrogen atmosphere to the non-nitrogen atmosphere (diffusion) by controlling the gas composition.

The treatment process (b) shown in the figure is a process in which the nitriding treatment and the diffusion process are discontinuously performed. The nitriding treatment is performed through the ion nitriding method, and the diffusion process is performed by raising and maintaining the temperature using a vacuum heat treatment furnace. It is possible to employ a process under a non-oxidizing atmosphere, for example, under an inert gas atmosphere of $N_2$, Ar or the like using an atmospheric pressure heat treatment furnace.

Figure 5:
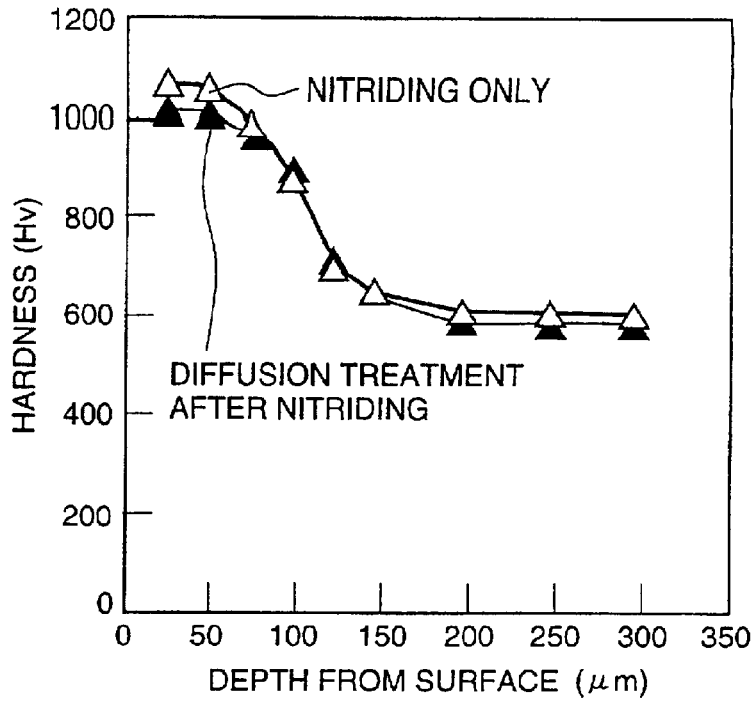
FIG. 5 is a graph showing the hardness distribution in the nitride layer of alloy tool steel in the first embodiment in accordance with the present invention.

FIG. 5 is a graph showing the hardness distribution in the nitride layer of alloy tool steel SKD11 which is used to form the plunger in the first embodiment in accordance with the present invention. The surface hardness of the nitrided layer was targeted above Hv 1000, and the hardened depth above Hv 500 was targeted above 0.1 mm. The treating condition is that the treating temperature is 530° C., the treating time is 8 hours, the gas composition is $N_2/H_2=1/3$, and the treating pressure is 400 Pa. It can be understood from the hardness distribution for the tool steel SKD11 treated only nitriding that the hardness is Hv 1060 from the surface to a position of 25 μm depth, and then gradually decreases toward the inner side to approach to the hardness of the base material.

The diffusion process was performed using the treated article having the above-mentioned hardness distribution. The diffusion process is performed through the ion nitriding process under the condition of the treating temperature of 550° C., the treating time of 2.5 hours, the process gas composition of $H_2$ only, and the treating pressure of 400 Pa. It can be understood from the hardness distribution for the tool steel performed with the diffusion process after the nitriding treatment that the hardness is Hv 1010 from the surface to a position of 25 μm depth, and then gradually decreases toward the inner side to approach to the hardness of the base material.

According to an analysis result of the surface layer, the ϵ-phase of the white compound composed of $Fe_2N$, $Fe_3N$ was eliminated. By performing the nitriding processing and the diffusion processing, it is not necessary to grind the surface of the brittle ϵ-phase, and it is also possible to form the nitrided layer having controlled hardness and toughness.

From the results, by performing the nitriding processing and the diffusion processing which are employed in the method of the present invention, the nitrided layer having controlled hardness and toughness is formed. Further, the compound on the surface layer can be controlled. Thereby, it is possible to provide a diffusion surface layer on which a highly hard carbon group film is to be formed.

Figure 6:
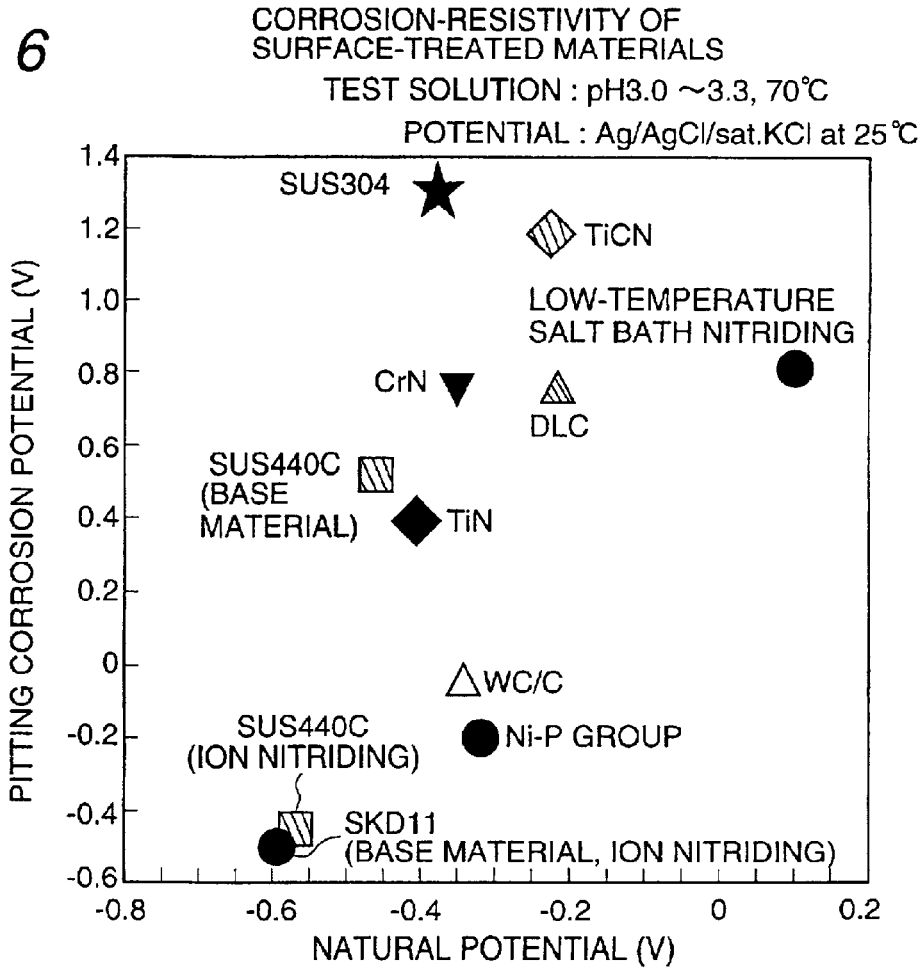
FIG. 6 is a graph showing the corrosion resistance of various kinds of surface treated materials in the first embodiment in accordance with the present invention.

FIG. 6 shows the corrosion resistance of various kinds of materials. The graph shows the relationship between natural potential and pitting corrosion potential in a solution containing ethyl alcohol of 13.5 vol. % in water and having an acid ion concentration of total acid value 0.13 mgKOH/g. A material having a higher natural potential and a higher pitting corrosion potential is good in corrosion resistance. The various kinds of stainless steels are in a higher natural potential and higher pitting corrosion potential range, and accordingly are good in corrosion resistance. On the other hand, tool steel SKD11 and the nitrided materials of the tool steel are in a lower range. Further, it can be known that the nitrided material of stainless steel SUS440 is also in the lower range, and accordingly that the corrosion resistance is decreased by the nitriding treatment.

The fuel pump is assumed to use gasoline adding with methyl alcohol or methyl alcohol to gasoline or degraded gasoline. In the case of using such gasoline, it is necessary to take it into consideration that the material is influenced to be oxidized due to mixing of water content and mixing of acid content. That is, a corrosion wearing phenomenon may occur when the contact portions of the sliding mechanism portions are under an oxidizing environment. In such a case, there occurs a problem in that the environment to wearing becomes severer, and accordingly the amount of wear in the sliding portion will be increased.

Therefore, in the present invention, the highly hard carbon group film having corrosion resistant and wearing resistant is formed on the topmost surface of the material, as shown in FIG. 3. The carbon group film is made of diamond-like carbon (DLC).

The carbon group film of diamond-like carbon (DLC) is formed through, for example, the high frequency plasma CVD method, the ionization vapor deposition method, an unbalanced magnetron sputter method and so on, but the method is not limited to these.

The carbon group film formed through these methods has a good corrosion resistance due to the close-grained structure and the non-metallic property. It can be understood from FIG. 6 that the diamond-like carbon (DLC) is in the higher region of natural potential and pitting corrosion potential, and accordingly is good in corrosion resistance. Further, TiN, TiAlN and CrN (the base material is SKD11) are also in the higher region of natural potential and pitting corrosion potential compared to the various kinds of stainless steel except SUS304, and accordingly are good in corrosion resistance. As described above, the corrosion resistance of the SKD11 steel coated with the diamond-like carbon (DLC) is substantially improved compared to that of the base material of the SKD11 steel.

Figure 7:
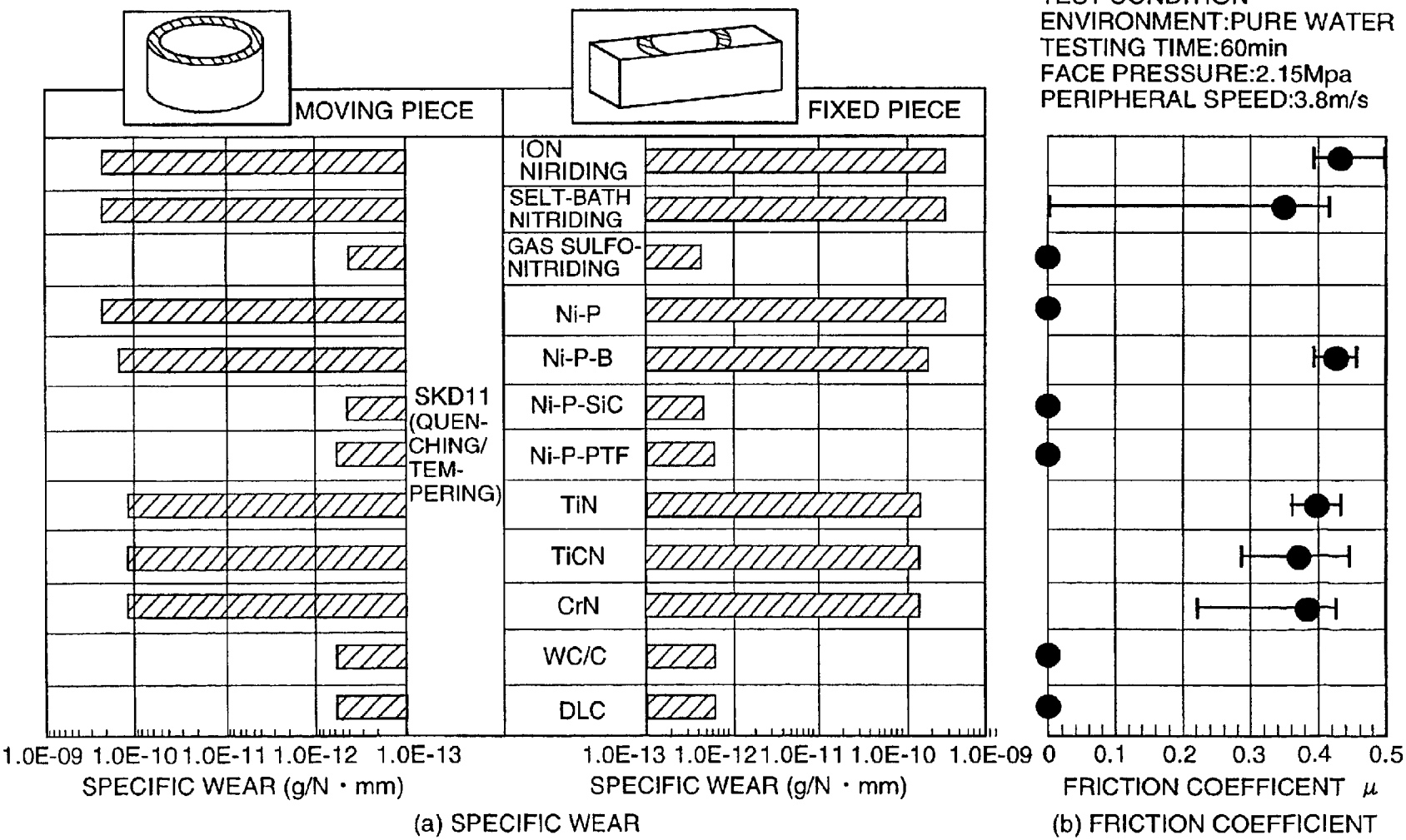
FIG. 7 is a graph showing wearing test results of various kinds of surface treated materials.
Figure 8:
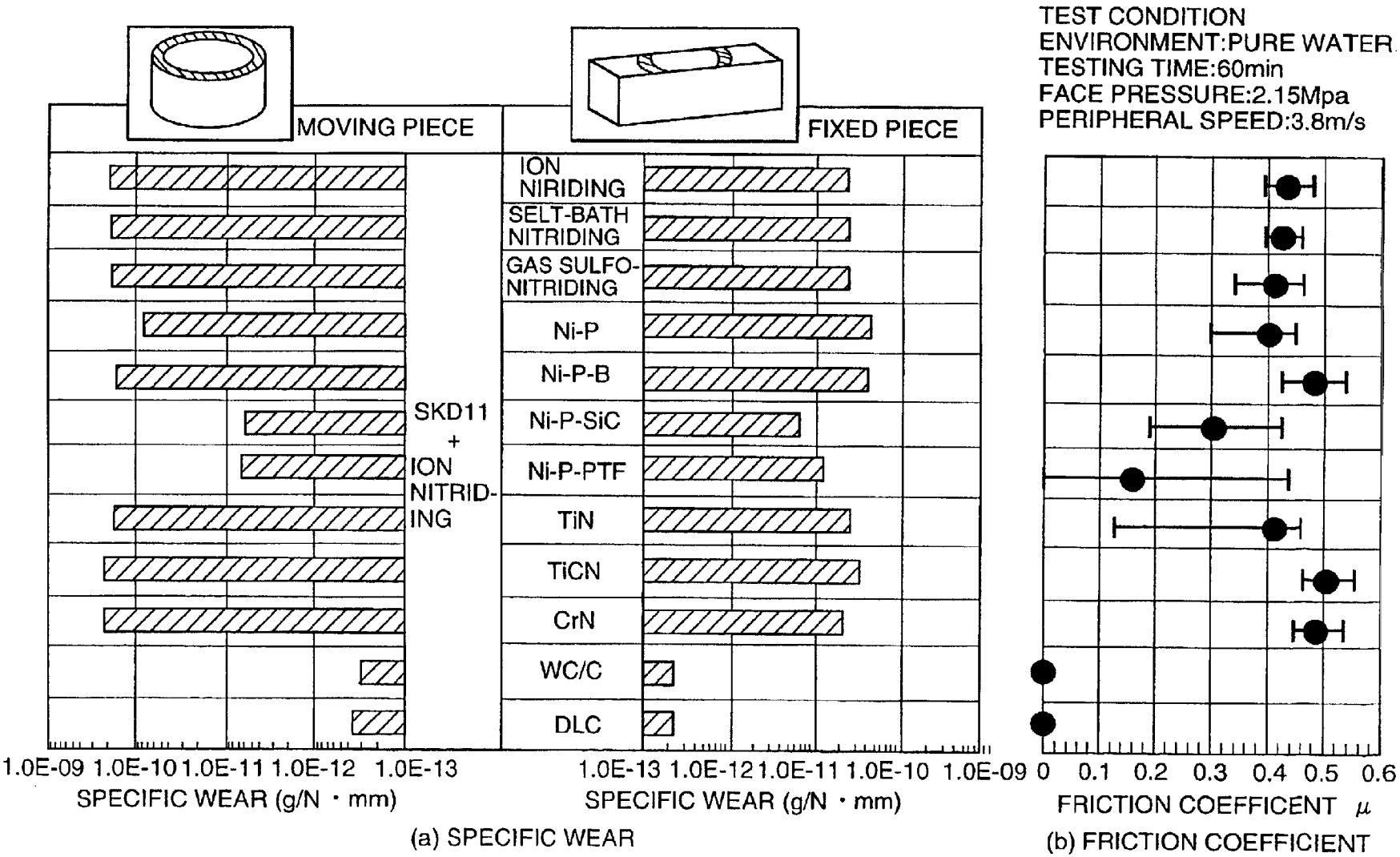
FIG. 8 is a graph showing wearing test results of various kinds of surface treated materials.

Further, the carbon group film has an effect to suppress metal transfer bonding phenomenon caused between the base material and the pairing material, and has a small friction coefficient, and prevents initial wear, normal wear and seizing. Therefore, the SKD steel with carbon group film showed a smaller amount of wear compared to the various kinds of materials shown in FIG. 7 and FIG. 8. Further, the SKD film with carbon group film is good in corrosion resistance. From these facts, the SKD steel with carbon group film can be used for a sliding member operated in a fuel of a severe corrosion environment.

Figure 9:
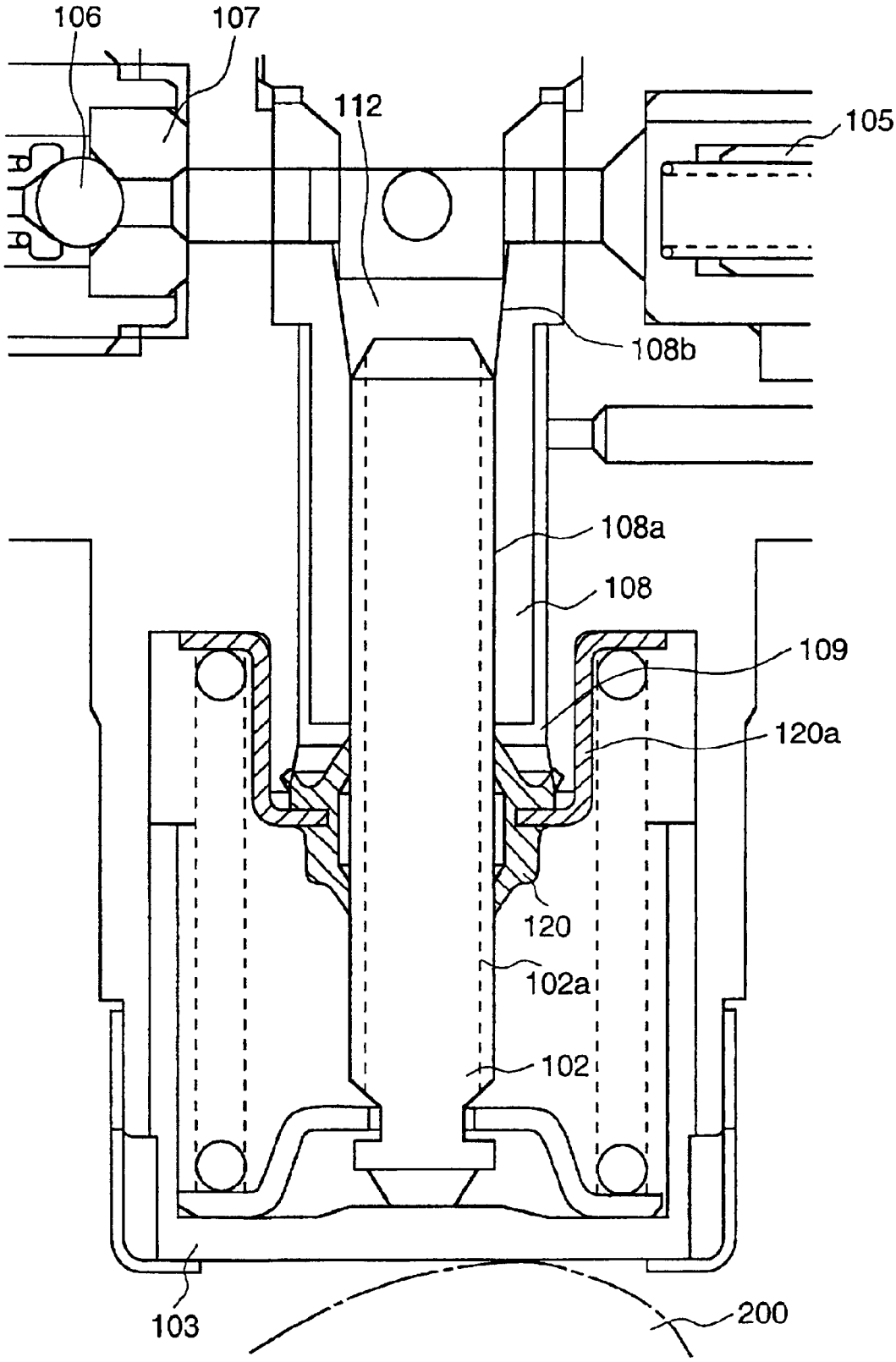
FIG. 9 is an enlarged partial view showing the surface treated layer in the plunger of FIG. 1 in accordance with the embodiment 1.

This is the reason why the surface structure shown in FIG. 3 is employed for the plunger 102. FIG. 9 is a detailed view showing a part of the plunger in the embodiment 1. The fuel of gasoline is supplied through the suction valve 105 and then introduced into the pressurizing chamber 112. Since the fuel is pressurized in the pressurizing chamber 112, the fuel leaks to the outside through the radial gap for sliding of the plunger 102 with the sliding bore 108*a* of the inner portion of the cylinder 108. The amount of the leakage is minimized by sealing the leakage using a seal 120.

Wearing occurs by sliding between the cylinder and the plunger, and between the plunger and the seal. In order to cope with wear of the seal 120 (an elastic body, for example, rubber) and the plunger 102, and to cope with wear of the plunger 102 and the cylinder sliding bore 108*a*, a diffusion surface treated layer and a surface treated layer 102*a* of a highly hard carbon group film having corrosion resistance and wear resistance are formed in the plunger 102.

In the present embodiment, the corrosion resistant and wear resistant hard film and the diffusion surface treated layer I of FIG. 3(*a*) are formed in the surface treated layer 102*a*. The alloy steel SKD11 is employed as the base material, and a nitrided layer of 100 $\mu$m thick shown in FIG. 5 is formed for the diffusion surface treated layer I. The surface is coated with a DLC film of 1.5 $\mu$m thick.

In the present embodiment, a seal 120 made of an elastic body is arranged in the outer periphery of the plunger 102 to prevent oil for lubricating a cam 200 from flowing into the inside of the fuel pump and to prevent the fuel inside the pump from flowing out. In the present embodiment, the seal 120 is integrated in a one piece together with a metal tube 120*a*, and is press fit to the at pump main body 100. However, the fixing method is not limited to the above.

Further, the pressurizing chamber 112 is composed of the cylinder 108 having the sliding bore for reciprocally slidably supporting the plunger 102. The bore portion of the cylinder 108 is composed of the sliding bore 108*a* which has a radial gap between the sliding bore 108*a* and the plunger 102 below 10 $\mu$m in order to minimize fuel leakage from the pressurizing chamber; and an expanding inner wall 108*b* for forming the pressurizing chamber.

Further, a vertical passage 109 communicating with the sliding bore 108*a* is provided in the outer peripheral portion of the cylinder 108, and the vertical passage 109 communicates with a fuel suction passage 110 which communicates with a fuel inlet port 110*a* through a horizontal passage 110*b*. A check valve 400 for restricting a flow direction from the fuel suction passage 110 side to the vertical passage 109 side is provided in the inlet port of the horizontal passage 110*b*.

By the construction described above, the fuel flowing from the pressurizing chamber 112 through the gap between sliding bore 108*a* and the plunger 102 at pressurizing stroke can flow toward the lower pressure portion of the fuel suction passage 110 side. Therefore, the pressure in the fuel chamber side of the seal 120 becomes equal to the pressure in the fuel suction passage 110, and accordingly it is possible to prevent the fuel from leaking outside without largely increasing the rigidity of the seal 120.

Further, since the leakage of the fuel in the pressurizing chamber 112 through the gap in the plunger sliding portion can be suppressed to the minimum, it is possible to improve the efficiency of the pump delivery at normal operation.

In the present embodiment, as main members required to be corrosion resistant and wear resistant among the members operated and sliding in the fuel, there are the suction valve 105 and the delivery valve 106 provided in the fuel suction passage 110 and the delivery passage 111, and the plunger 102 of the pressurizing member of the pressurizing chamber 112, and the cylinder 108 having the sliding bore for reciprocally slidably supporting the plunger 102.

Particularly, the radial gap between the plunger 102 and the cylinder 108 is set to a value smaller than 10 $\mu$m in order to minimize the fuel leakage from the pressurizing chamber. Therefore, the pump performance may be reduced by increase of the radial gap due to sticking caused by seizing or abnormal wearing.

Figure 10:
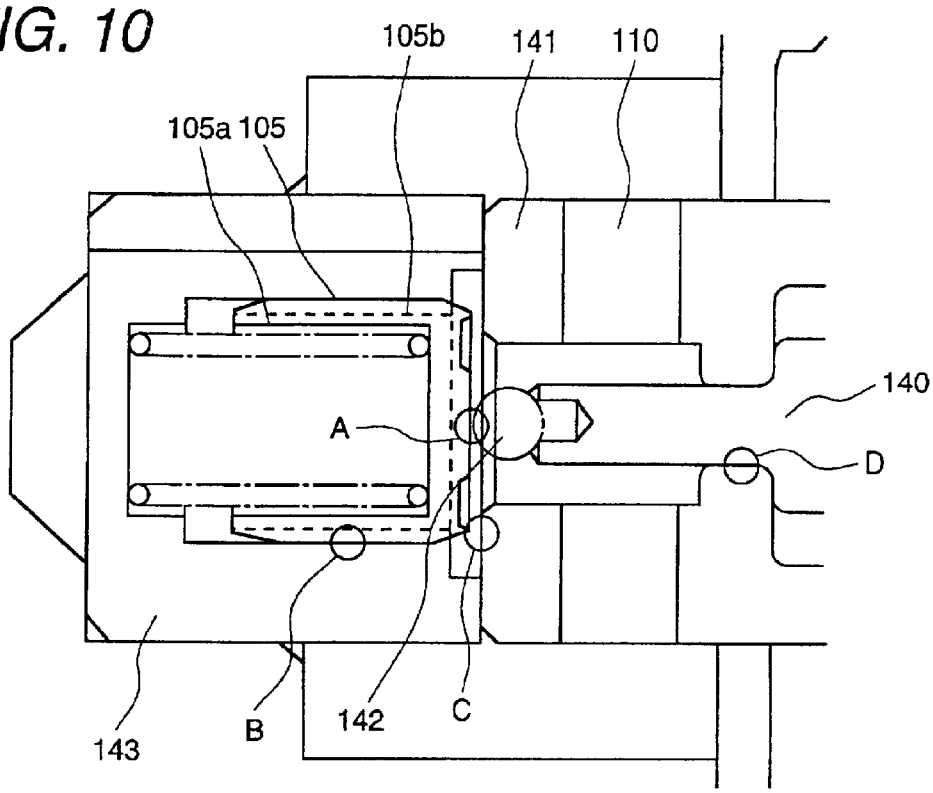
FIG. 10 is an enlarged partial view showing the surface treated layer in the suction valve of FIG. 1 in accordance with the embodiment 1.

An application of the present embodiment to the other wear portions will be described below. FIG. 10 is a detailed view showing part of the suction valve 105, and FIG. 11 is a detailed view showing part of the delivery valve 106.

In the portion of the suction valve 105 shown in FIG. 10, fuel is supplied from the fuel suction passage 110, and sucked into the pressurizing chamber 112 through the gap between a ball 142 and the suction valve 105 when a plunger rod 140 is reciprocally moved. The portions having the problem of wearing are A: the contact portions of the ball 142 and the suction valve 105; B: the sliding portions of the suction valve 105 and the check valve guide 143; C: the portions of the plunger guide 141 and the sheet portion of the suction valve 105; and D: the supporting portion of the plunger rod 140.

Figure 11:
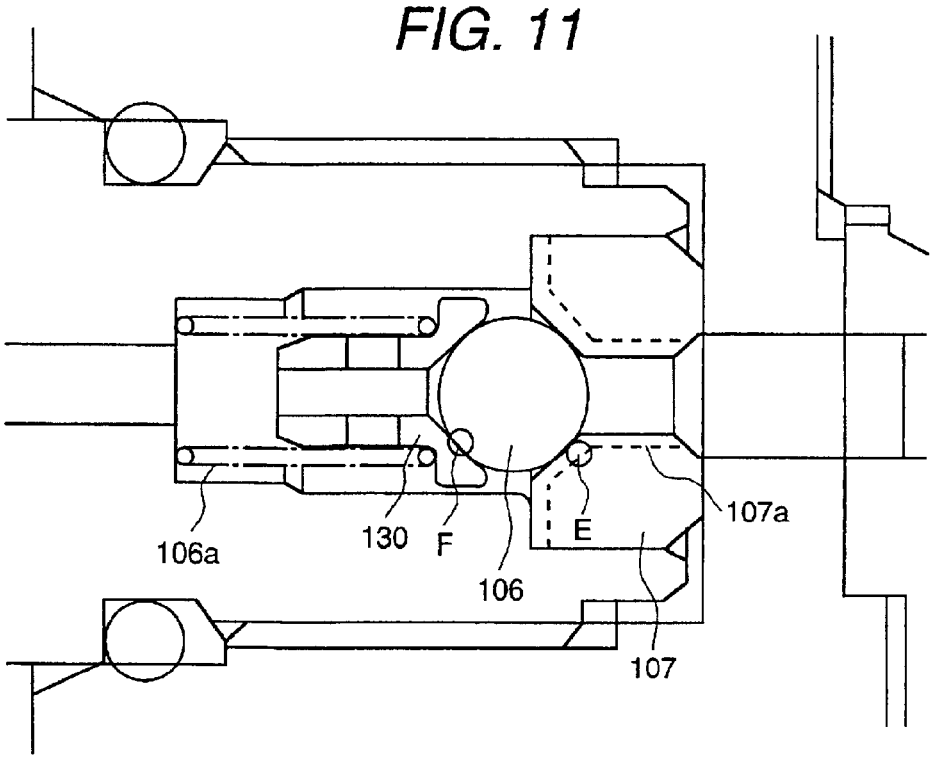
FIG. 11 is an enlarged partial view showing the surface treated layer in the delivery valve of FIG. 1 in accordance with the embodiment 1.

In the portion of the delivery valve 106 shown in FIG. 11, the fuel is pressurized in the pressurizing chamber 112, and delivered by opening and closing of the delivery valve 106. The portions having the problem of wearing are the contact portion of the check valve sheet 107 and the delivery valve 106; and F: the contact portions of the delivery valve 106 and the check valve holder 130.

In order to cope with the wear in each of the portions described above, a surface treated layer composed of a diffusion surface treated layer and a highly hard carbon group film having corrosion resistance and wear resistance was formed each of the parts. In the present embodiment, the surface treated layers 105*b* and 107*a* composed of the corrosion resistant and wear resistant hard film and the diffusion surface treated layer I if FIG. 3(*a*) were formed in the suction valve 105 shown in FIG. 10 and in the check valve sheet 107 shown in FIG. 11, respectively. Stainless steel SUS420J was employed as the base material, and the nitrided layer of 50 μm thick was formed as the diffusion surface treated layer I. A WC/C film of 2 μm thick was formed on the surface.

A series of endurance test using an actual radial plunger pump of FIG. 1 having the fuel chamber structure described above was conducted. As the result of the test, the pump could be operated without any abnormality, and could obtain a stable value in gasoline delivery flow rate. After completion of the endurance test, the pump was disassembled to inspect the parts in the fuel chamber. As the result of the inspection, occurrence of no abnormal wear could be found in any of the parts, and all of the parts were in the normal wear state. Further, the wear amounts of the parts in the worn portions of the suction valve 105 and the delivery valve 106 were small. On the other hand, in an untreated radial plunger pump, some thickness thinning due to wearing was observed in the outer radial periphery of the plunger 11 and the sliding portion of the seal 17.

It can be understood from the above-mentioned results that in the pump constructed according to the present invention, sticking between the sliding parts hardly occurs, and the wearing resistance is improved. Since the surface treated layer composed of the corrosion resistant and wear resistant hard film and the diffusion surface treated layer is formed, the corrosion resistant and wear resistant film is hardly separated and accordingly has a good characteristic in corrosion resistance. By these characteristics, the wearing resistance under the severe environment is improved, and accordingly the targeted fuel pump can be obtained.

Embodiment 2

Figure 12:
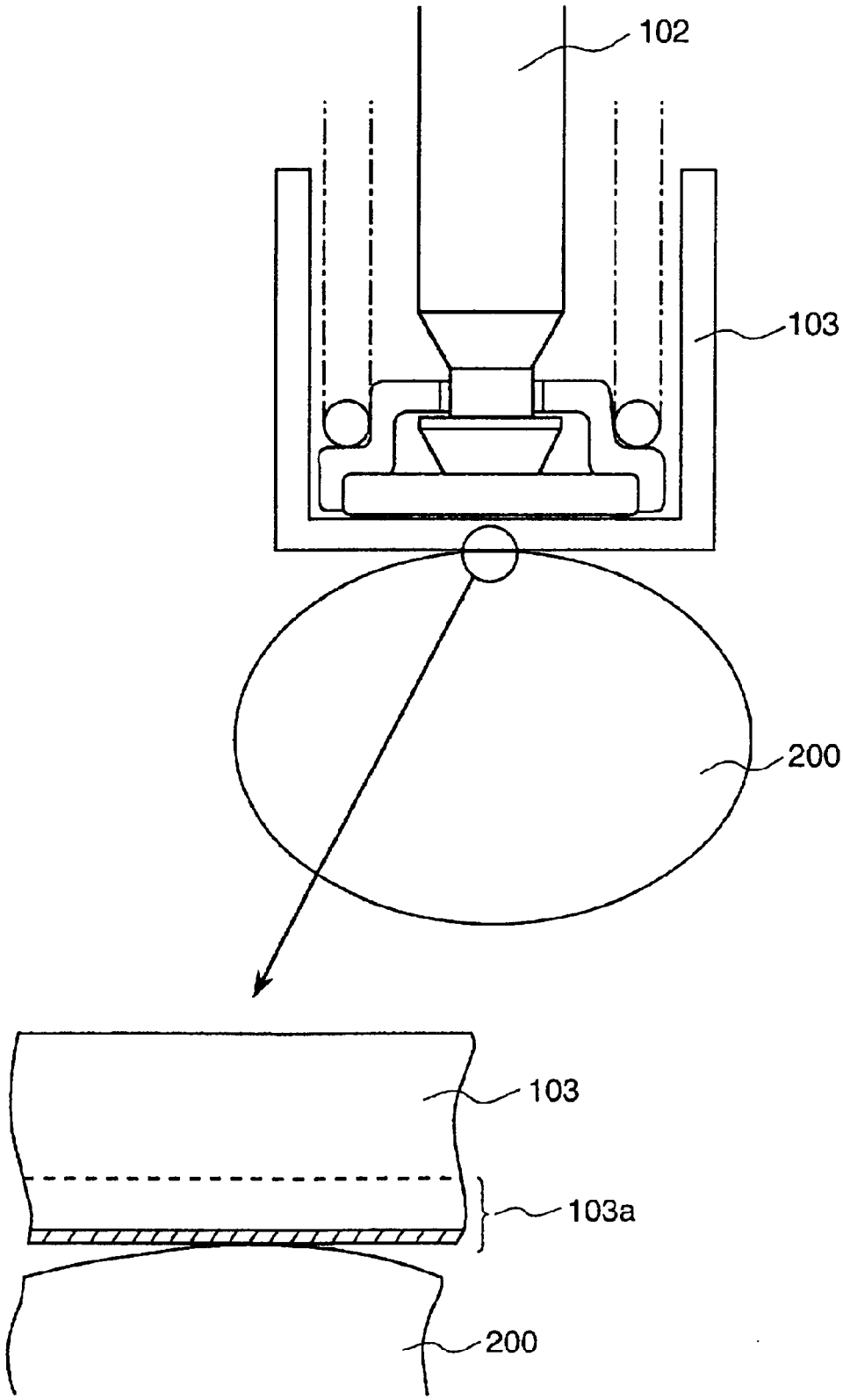
FIG. 12 is an enlarged partial view showing the surface treated layers in the driving cam and the lifter of FIG. 1 in accordance with the embodiment 2.

FIG. 12 is an enlarged cross-sectional view showing details of a part of the radial plunger pump of FIG. 1. Description will be made on another embodiment when a sliding mechanism portion requiring the corrosion resistance and the wearing resistance is constructed in the radial plunger pump of FIG. 1. FIG. 12 shows the embodiment in regard to a sliding portion between a driving cam rotated by transmitting a driving force of the engine to the cam and a lifter for converting the rotating motion of the driving cam to the reciprocal motion of the plunger.

There is a possibility that lubrication between the driving cam and the lifter portion is insufficient because engine oil in a spray state may be supplied to the portion. Since the driving cam moves at a high speed equal to or ½ of the rotation speed of the engine, the relative sliding speed on the lifter surface becomes +30 m/s to −4 m/s. Further, the driving cam is in contact with the lifter portion at a pressure above 500 MPa. Therefore, the driving cam and the lifter portion compose a mechanical portion sliding under a condition of high peripheral speed and high surface pressing pressure, and accordingly are required to be wear resistant. In order to improve the wear resistance of the driving cam and the lifter portion, a nitrided layer is provided to the surface of the lifter and a highly hard carbon group film is formed in the surface.

In the present embodiment, the surface treated layer 103*a* of the lifter 103 was composed of the corrosion resistant and wear resistant hard film and the diffusion surface treated layer I of FIG. 3(*a*). The alloy tool steel SKD11 was employed as the base material, and a nitrided layer of 100 μm thick shown in FIG. 5 was formed as the diffusion surface treated layer I. A DLC film of 1.5 μm thick was formed on the surface. A casting iron is used for the driving cam.

A series of endurance test using an actual radial plunger pump of FIG. 1 having the structures of the driving cam and the lifter portion described above was conducted. As the result of the test, the pump could be operated without any abnormality, and could obtain a stable value in gasoline delivery flow rate. After completion of the endurance test, the pump was disassembled to inspect the parts in the fuel chamber. As the result of the inspection, occurrence of no abnormal wear could be found in any of the parts, and all of the parts were in the normal wear state. Further, the wear amounts of the parts in the worn portions of the driving cam 200 and the lifter portion 103 were small. On the other hand, in an untreated lifter portion 103, occurrence of flaking and some thickness thinning due to wearing were observed.

It can be understood from the above-mentioned results that in the pump constructed according to the present invention, sticking between the sliding parts hardly occurs, and the wearing resistance is improved. Since the surface treated layer composed of the corrosion resistant and wear resistant highly hard carbon group film and the diffusion surface treated layer is formed, the corrosion resistant and wear resistant film is hardly separated and accordingly has a good characteristic in corrosion resistance. By these characteristics, the wearing resistance under the severe environment is improved, and accordingly the targeted fuel pump can be obtained.

Embodiment 3

Figure 13:
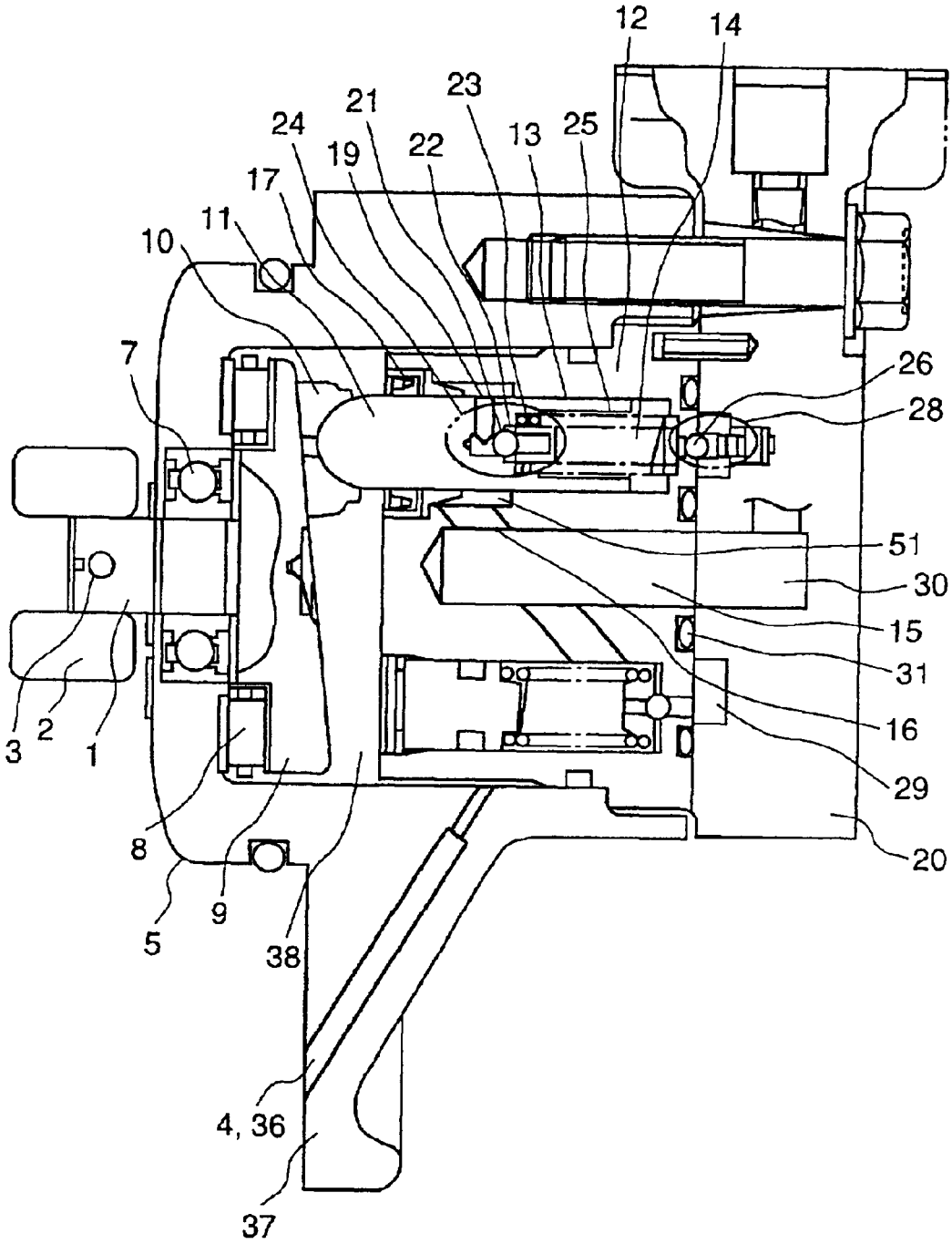
FIG. 13 is a cross-sectional view showing a second embodiment of a fuel pump in accordance with the present invention.

FIG. 13 is a cross-sectional view showing an example of an axial plunger fuel pump of a slant plate type (three cylinder type). The slant plate type axial plunger pump comprises a shaft 1 for transmitting a driving force from the external to the inside of the housing; a slant plate 9 for converting rotating motion to oscillating motion through the shaft; plungers for converting the rotating motion of the slant plate to reciprocal motion through a slipper 10; and cylinder bores 13 for sucking and delivering fuel, each of the cylinder bores being coupled with each of the plungers 11. The smooth surfaces of the slant plate 9 and the slipper 10 lubricated by a lubricating oil (engine oil) are designed so as to use a material selected by considering seizing resistance in a range of high slipping speed (high peripheral speed), and the spherical portions of the slipper 10 and the plunger 11 are designed so as to use a material selected by considering wear resistance in line contact under a high surface pressing pressure. The slipper 11 is formed of an iron group sintered member having an oxide layer. In regard to the slipping surfaces of the plunger 11 and the cylindrical slipping portion of the cylinder bore 13 lubricated by fuel (gasoline), a hardened layer selected from the group consisting of a nitrided layer, a carbonitrided layer and a carbonization quenched layer is formed on both of the surfaces. Otherwise, a hardened layer selected from the group consisting of a nitrided layer, a carbonitrided layer and a carbonization quenched layer or a film selected from the group consisting of a carbide, a nitride and a carbonitride having corrosion resistance and wear resistance is formed on the outer surface of the plunger 11. A hardened layer selected from the group consisting of a nitrided layer, a carbonitrided layer and a carbonization quenched layer is formed on the inner peripheral surface of the cylinder bore 13.

The structure of the fuel pump has a small number of members sliding in the gasoline by providing a seal member in the end portion of the sliding portion between the plunger 11 and the cylinder bore 13. Therefore, it is unnecessary to arrange a bellows for separating the lubricating oil and the fuel used in a conventional pump, and the lubrication of the driving mechanism portion is sufficient.

As shown in FIG. 13, a coupling 2 for transmitting the driving force transmitted from the cam shaft of the engine has the shaft 1 which is connected by a pin 3 fit to the coupling 2. The shaft 1 is integrated with the slant plate 9 which expands in the radial direction and has a slant plane in the end portion. The slippers 10 are in contact with the slant plate 9. In the outer peripheral portion of the slipper 10 in the side of the slant plate 9, there is provided a taper for assisting to form an oil film between the slant plate 9 and the slipper 10. Further, another end of the slipper 10 is formed in a spherical shape, and supported by a sphere formed in the plunger 11 sliding inside the cylinder bore 13, and the oscillating motion generated by rotation of the slant plate 9 is converted to reciprocal motion of the plunger 11.

In the pump having the structure described above, suction and delivery of fuel is performed as follows. The plurality of the cylinder bores 13 and the plurality of the plungers 11 form the individual pump chambers 14 in the cylinder 12. A suction space 15 communicating with each of the plungers 11 is formed in the central portion of the cylinder so that fuel is supplied to the pump chamber 14. In order to conduct fuel to the suction space 15, a pump external fuel pipe is attached to a rear body 20 so that the suction chamber 30 in the central portion of the rear body 20 is connected to the suction space 15 provided in the cylinder 12 through a suction passage inside the rear body 20.

Inside of the plunger 11, there is a suction valve 24 (check valve) for sucking the fuel which is constructed of a ball 21 and a spring 22 and a stopper 23 for supporting the spring 22. A plunger spring 25 always pushes the plunger 25 toward the slant plate 9 side in order to follow the plunger 11 together with the slipper 10 to the slant plate 9.

A passage A16 communicating with the suction valve 24 inside the plunger 11 is formed as a communicating passage between a backfacing 51 provided in the cylinder bore and the suction space 15. The backfacing 51 has a diameter larger than a diameter of the cylinder bore 13, and the backfacing 51 is formed down to a depth capable of communicating between an introducing hole 19 and the backfacing 51 when the volume of the pump chamber 14 becomes sufficiently small (when the position of the plunger reaches its top dead point) so that the fuel may be always introduced into the plunger 11.

Figure 14A:
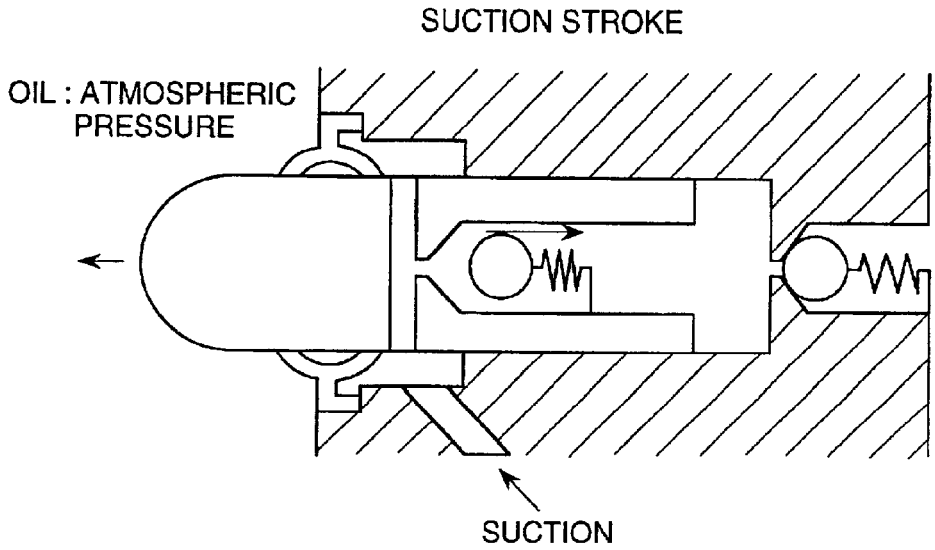
FIG. 14 is a view showing the strokes in the second embodiment of the fuel pump in accordance with the present invention.
Figure 14B:
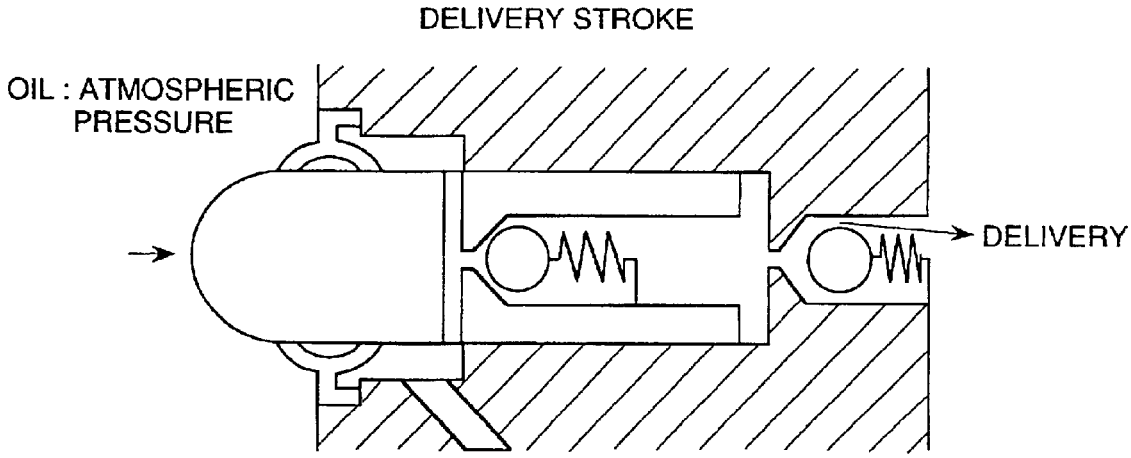

FIG. 14 is an enlarged view of the plunger 11, explaining the suction and the delivery strokes. In the suction stroke (a stroke in which the plunger 11 is moved toward a direction that the volume of the pump chamber 14 is increased), the fuel is sucked into the pump chamber 14 by opening the suction valve 24 provided inside the plunger 11 at a timing when the pressure inside the pump chamber 14 provided in the plunger 11 becomes lower than a preset pressure. When the delivery stroke (a stroke in which the plunger 11 is moved toward a direction that the volume of the pump chamber 14 is decreased) is started, the fuel sucked into the pump chamber 14 during the suction stroke is delivered from the pump chamber 14 to the delivery chamber 29 provided in the rear body 20 by opening the delivery valve 28 constructed of a ball 26 and a spring at a timing when the pressure inside the pump chamber 14 reaches a preset pressure, similarly to the suction valve 24. There, the passage structure of the pump itself is made compact by separating the suction chamber 30 provided in the rear body 20 from the delivery chamber 29 by an O-ring 31, and by arranging the suction chamber 30 at a position closer to the center than a position of the delivery chamber 29.

The load generated by the fuel pressure in the pump chamber is transmitted to the slant plate 9 of the shaft 1 through the plunger 11 and the slipper 10. That is, a resultant force of the loads of the plurality of plungers 11 acts on the slant plate 9. The resultant force acts on the slant plate 9 as the sum of an axial load and a radial load of a slanting angle component. In order to attain smooth rotation by bearing these loads, a radial bearing 7 and a thrust bearing 8 are fit to the shaft 1 to bear the loads with the body 5.

The portions bearing these loads (the slippers 10/ the slant plate 9, the slippers 10/ the plunger spheres and the bearing portion) are portions bearing the relative velocity due to rotation and the loads, and the slipping wear can be reduced by employing oil lubrication. In order to do so, a structure for storing oil is necessary in a slant plate chamber 38 formed between the body 5 and the cylinder 12.

In the present embodiment, in the cylinder 12 there is provided a seal 17 for sealing the fuel from the oil when the plunger is reciprocally moved. The reciprocally oscillating seal 17 seals a gap between the plunger 11 and the cylinder bore 13, and the seal 17 becomes a sealing member between the fuel and the oil. In the present embodiment, the pressure acting on the seal 17 is always a low pressure of the suction pressure described above because there is the communicating passage 16 between the seal 17 and the pump chamber 14, and accordingly the pressure of the high pressure chamber is not applied to the seal 17. Therefore, the durability and the reliability of the seal 17 are increased.

Figure 15:
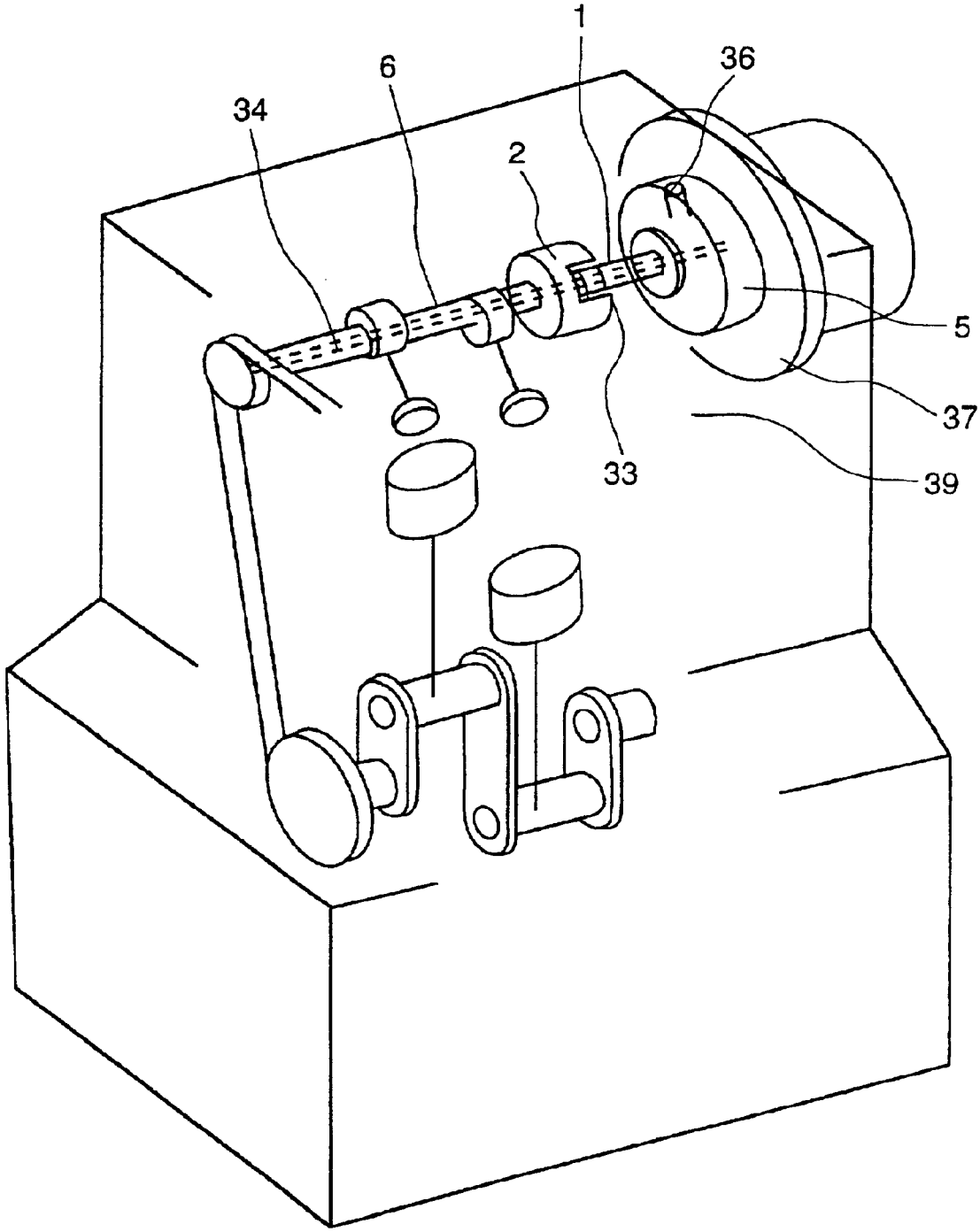
FIG. 15 is a perspective view showing the circulation path of engine oil.

FIG. 15 is a perspective view of the engine portion explaining the circulation path and a circulation method of the engine oil. The structure is that the shaft 1 penetrating through a shaft seal 35 and a coupling is fit into a coupling fitting portion 33 of an engine cam 6 having an oil passage 34 in the axial center, and oil is introduced from the engine through a communicating passage 4 with the slant plate chamber 38 provided in the center of the shaft 1. The shaft seal 35 does not completely seal the oil so that the minimum necessary flow rate of the oil from the engine side to the slant plate chamber 38 can be secured. By doing so, a decentering load caused by displacement in the centers between the engine cam 6 and the shaft 1 acting on the driving shaft through the shaft seal 35 can be suppressed as small as possible, and accordingly the durability of the radial bearing 7 can be improved. Further, by limiting the oil flowing into the slant plate chamber 38 to the minimum necessary amount, replacement of oil diluted by fuel leaking into the slant plate chamber 38 through the seal 17 described above can be performed while temperature rise of the slant plate chamber 38 is being suppressed. Furthermore, the compatibility with the engine and the small-sizing of the engine can be attained since the object is attained without setting an additional oil passage in the engine side by introducing the oil through the center of the shaft 1.

Although the oil is introduced through the communicating passage 4 provided in the center of the shaft in the present embodiment, the oil introducing passage is arranged so that an oil pressure source of the engine communicates with the slant plate chamber 38 of the pump. Description will be made below on a passage for returning the oil supplied from the engine to the slant plate chamber 38. The passage is formed of a returning passage from the slant plate chamber 38 to an engine cam chamber 39. This returning passage 36 is arranged at a position in the coupling 2 side nearer than a mounting flange face 37 to the engine provided in the pump body 5. By doing so, the oil in the slant plate chamber 38 can be returned to the engine without providing a special passage in the engine side. By making the amount of the oil flowing out from the slant plate chamber 38 not smaller than the amount of oil flowing into the slant plate chamber 38 and by making the pressure inside the slant plate chamber 38 not increase using the returning passage 36, the reliability of the seal 17 is increased. Since the pressure inside the slant plate chamber 38 is not increased and is always kept lower than the suction pressure of the fuel, the oil is prevented from leaking to the fuel side.

The large different point of the structure described above from the conventional slant plate type axial plunger pump is that the slippers slip at a high peripheral speed on the slant plate in the lubricating oil. The rotating motion of the slant plate is converted to the oscillating motion through the slipper to reciprocally move the plunger. Therein, the lubricating oil is separated from the fuel by providing the seal member in the sliding portion between the plunger and the cylinder bore. Therefore, number of the components sliding under gasoline is reduced.

Initially, as these slipping members, description will be made on the material structures of the slant plate 9 and the slipper 10 which are lubricated by the lubricating oil (engine oil).

The slant plate is rotated by transmitting the driving force from the engine to the shaft. The rotation speed of the slant plate is ½ of the rotation speed of the engine, and is from a rotation speed at idling operation to a rotation speed in the high speed range. At that time, the sliding speed between the slant plate and the slipper becomes 0.3 to 5 m/s, and the surface pressing pressure becomes about 8 MPa although it depends on the delivery pressure. Therefore, it is required for the material structures that seizing between the slant plate and the slipper does not occur and the amount of normal wear is small under such a high peripheral speed sliding. Therefore, properties of various kinds of materials were evaluated, and the material structure for the slant plate and the slipper was studied.

Figure 16A:
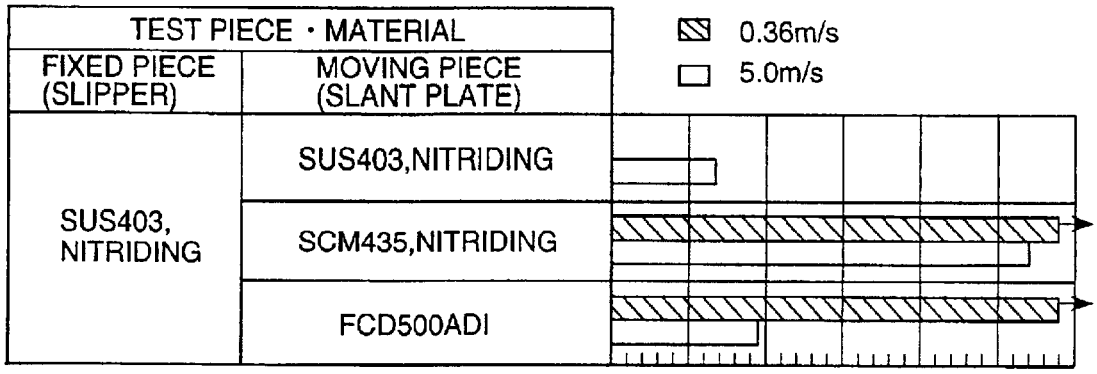
FIG. 16 is a graph showing the test results of seizing resistance between various kinds of materials for the slant plate and the slipper.
Figure 16B:
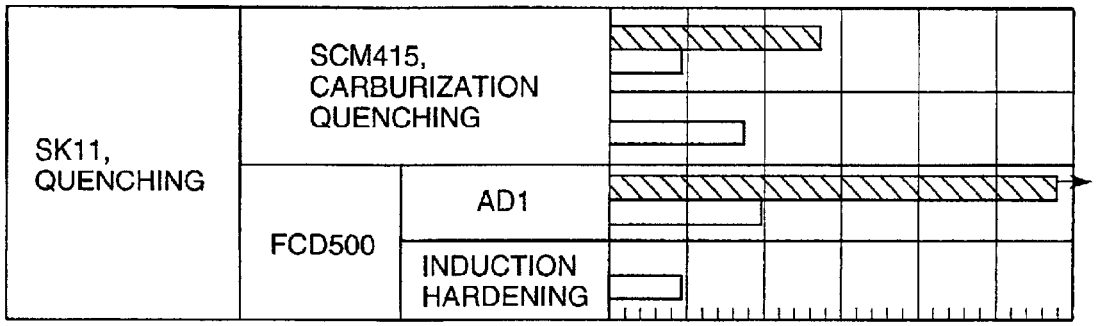
Figure 16C:
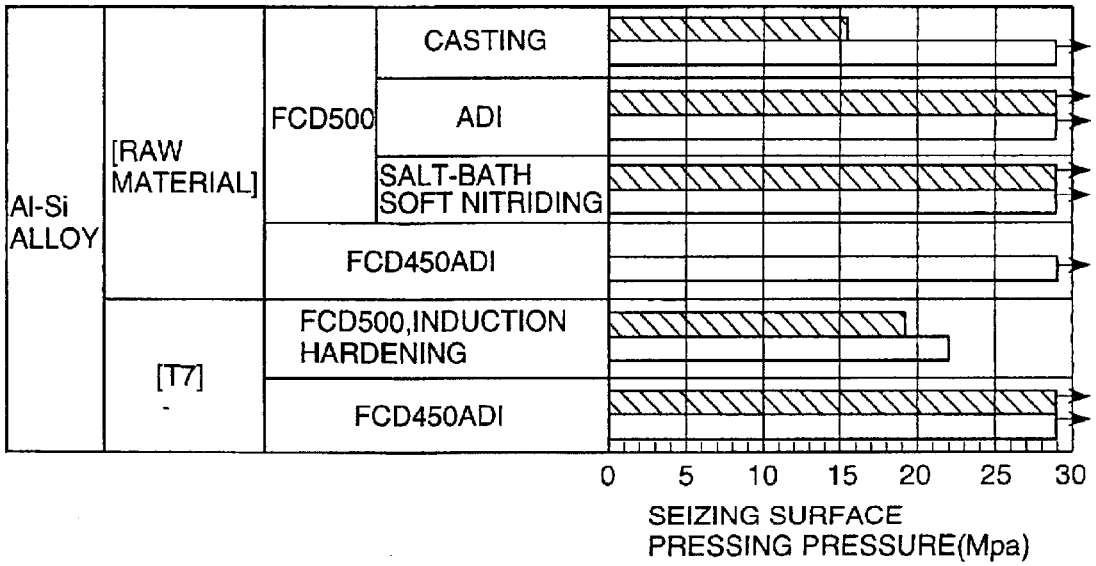
Figure 17A:
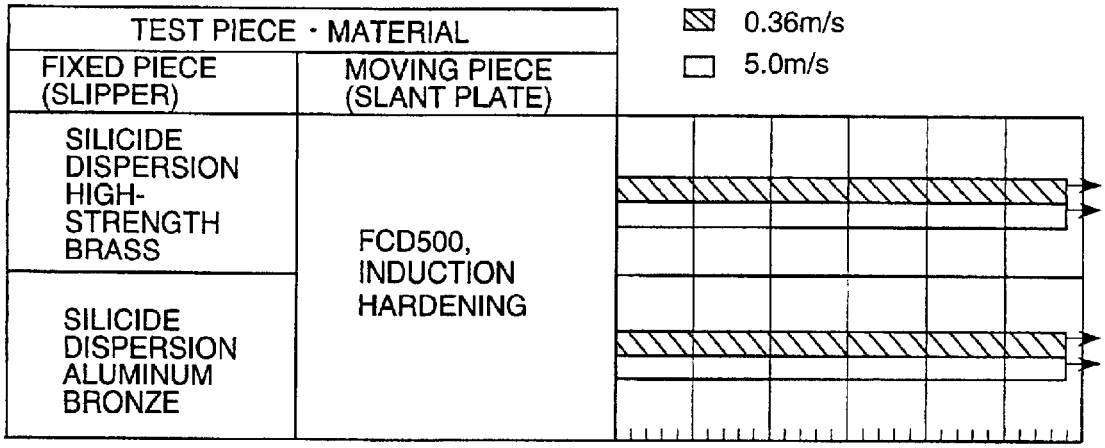
FIG. 17 is a graph showing the test results of seizing resistance between various kinds of materials for the slant plate and the slipper.
Figure 17B:
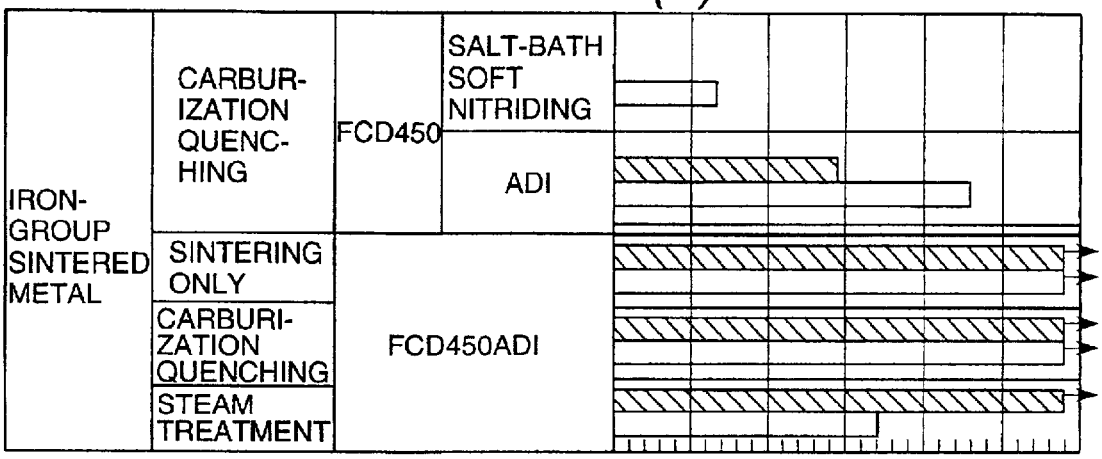
Figure 17C:
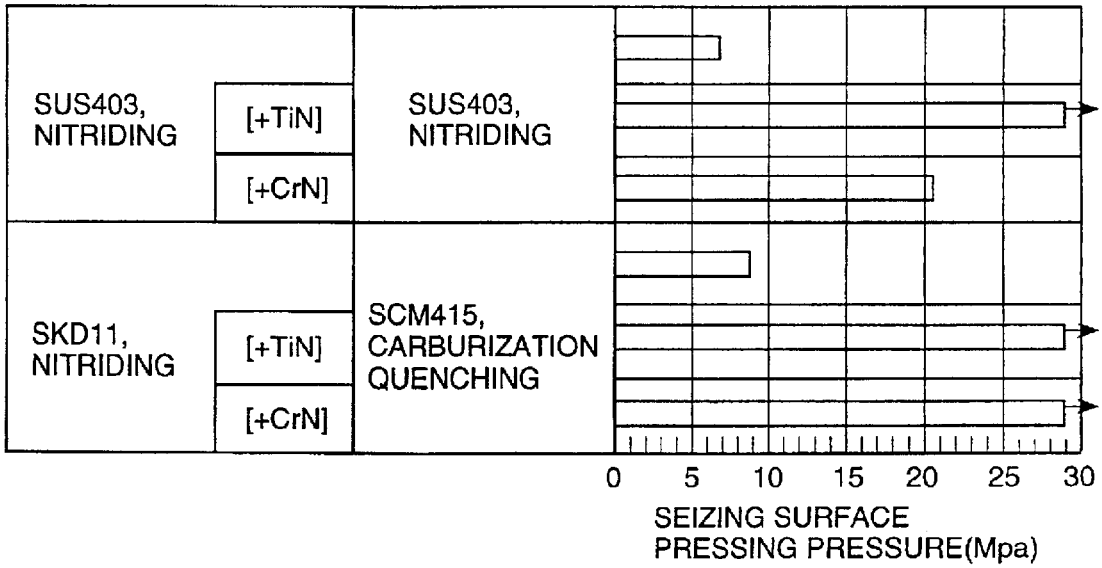

FIG. 16 and FIG. 17 are graphs showing the results of study obtained from seizing resistance tests on various kinds of materials for the slant plate and the slipper. Bending and fatigue strengths are required for the material of the slant plate because the slant plate has the function as the shaft transmitting the driving force. Therefore, as the materials for the slant plate, carburization quenched materials such as SCM415 as casehardened steels of machine structural steel; a nitriding treated material as a refining steel of SCM435; nitrided materials of SUS403 and SUS4290J2 as stainless steels; and a ductile iron (ADI) highly strengthened and highly toughened through austenitic tempering treatment as a casting iron were used as the test pieces.

Material specifications required for the slipper are wear resistance, seizing resistance and compression strength (above a maximum produced surface pressing pressure in the sphere side). As the materials for the slipper, a nitrided material of stainless steel SUS403; a quenched material of alloy tool steel SKD11; an aluminum alloy as an Al—Si alloy (A390); a silicide dispersed aluminum-bronze alloy as a copper group alloy; a high strength brass alloy; and a sintered-only material, a carburization quenched material and an oxide film formed material (oxidizing treated in steam of 550° C.) of iron group sintered materials (SMF4 species, tensile strength of 400 to 500 N/mm$^2$) were used as the test pieces. The oxide film formed material has a coated film having $Fe_3O_4$ as the major component. In addition to the above, a slipper made of a nitrided material of SUS403 as the base material with a TiN film or a CrN film (3 to 5 $\mu$m thick) and a slipper made of a nitrided material of SKD11 as the base material with a TiN film or a CrN film (3 to 5 $\mu$m thick) were also used as the test pieces.

Component tests on seizing resistance between the slant plate and the slipper were conducted by a rotation slipping method. The rotation slipping method is that slipping motion is performed by pushing the slipper against a rotating disk (the slant plate). The moving piece is the disk of $\phi$100×8 mm, and the fixed piece is the slipper. The load was set to a value of 0.98 MPa during an initial breaking-in period of 5 minutes, and then increased by increment of 0.98 MPa every 2 minute elapsing until the load reached 29.4 MPa. As the friction environment, lubrication oil (engine oil) was used.

It can be understood from the seizing-resistance test results of FIG. 16 and FIG. 17 that effects of difference among the slipper materials or difference among combination with the slant plate materials are important. In the case where the slipper is made of the nitrided material of SUS403 (Hv 750), the seizing surface pressing pressure becomes as low as 6.9 MPa when the moving piece is made of the nitrided material of SUS403 (Hv 1100), that is, when the moving piece is made of the same kind of the higher-hard combined material. However, in the case where the slipper is made of the nitrided material of SCM435 (Hv 660) having a hardness nearly equal to that of the material for the moving piece, the seizing does not occur even at the surface pressing pressure of 29.4 MPa in a low speed slipping, and does not occur even at the surface pressing pressure of 27.4 MPa in a high speed slipping either. That is, the combination of the materials shows a good result. In the case of the FCD500ADI material having a lower-hardness, the seizing does not occur even at the surface pressing pressure of 29.4 MPa in a low speed slipping, but occurs at the surface pressing pressure of 9.8 MPa in a high speed slipping. This shows that in the high speed slipping, the lower-hardness of the base material becomes more dominant than the effects of the solid lubricity and the oil retention ability of the spherical graphite.

In the case where the slipper is made of the quenched SKD11 material of the alloy tool steel (Hv 613 to 697), when the moving piece is made of the FCD500ADI material, the seizing does not occur even at the surface pressing pressure of 29.4 MPa in the low speed sliding condition. However, in the high speed sliding condition, the surface pressing pressure at occurrence of seizing is within the lower range in both cases of the SCM415 carburization quenched material (Hv 700) and the FCD500 induction hardening material (Hv 550 to 650). Therefore, it is found that the SKD11 material having a structure dispersing hard carbonate in the hard base material is worse in seizing resistance in the high speed sliding condition.

In the case of the slippers made of the Al—Si alloy, good seizing resistance is observed on the whole regardless of the heat treatment of the casting iron of the moving piece. As described above, the soft material of the Al—Si alloy is good in seizing resistance by the effect that uniformly distributed hard lumps of initial crystal Si and very small particles of eutectic Si contact with another material to form dimples capable of holding an oil film on the soft base material.

In the case where the moving piece is made of an induction hardened material of FCD 500 (Hv 550 to 650), the seizing surface pressing pressure of the slipper made of the copper alloy shows good seizing resistance without occurrence of seizing even at the surface pressing pressure of 29.4 MPa in both of the low speed sliding condition and the high speed sliding condition. The copper alloy has a structural effect that hexagonal $Mn_5Si_3$ silicide having self-lubricity contacts with another material to form dimples capable of holding an oil film on the base material.

The seizing surface pressing pressure of the slipper made of the carburization quenched material or the sintering-only material of the iron group sintered material shows good seizing resistance without occurring seizing even at the surface pressing pressure of 29.4 MPa in both of the low speed sliding condition and the high speed sliding condition. The iron group sintered material shows good wear resistance and good seizing resistance by an oil retaining effect obtained by specific holes existing in the sintered material.

The seizing surface pressing pressure of the iron group sintered material with the oxide film is slightly decreased in the high speed sliding condition. The reason can be considered that the holes specific to the sintered material are closed by the steam treatment to reduce the lubricity particularly in the high speed sliding condition due to decrease in the oil retaining effect, and that when the oxide film is broken, the broken oxide film flakes become hard extraneous objects to cause seizing starting points. However, the seizing surface pressing pressure of the iron group sintered material with the oxide film satisfies the seizing resistance above the maximum assumed surface pressing pressure in the actual pump.

The seizing surface pressing pressure of the slipper with the TiN or the CrN film is increased 2 to 3 times as large as that of the seizing surface pressing pressure of the nitrided base material of the slipper, and accordingly the effect of the film is remarkably observed. The reason is that because the TiN or the CrN film has a hardness as extremely high as Hv 2000 to 3000, and is chemically stable, the sticking hardly occurs in the sliding surface. Therein, the nitrided layer of the base material has an effect that occurrence of buckling of the TiN or the CrN film caused by a high stress produced on the sliding surface can be prevented by increasing the hardness of the base material.

It was found from the results described above that as the materials for the slipper and the slant plate, the combinations of the nitrided SUS403 material, the Al—Si alloy, the copper alloy, the material with the TiN coating film or the material with the CrN coating film for the slipper and the nitrided SCM435 or the casing iron for the slant plate satisfy the seizing resistance above the maximum surface pressing pressure (7.9 MPa) produced in the actual pump.

Wearing tests using an actual pump were conducted in the combinations of the slipper and the slant plate materials described above. An on-bench engine test was conducted to evaluate the wear resistance by assembling the slant plate and the slipper made of the various kinds of materials in an actual pump. The test was performed under test conditions of fuel temperature of 95° C., lubricating oil temperature of 135° C., fuel pressure of 7 MPa, and pump rotation speed 400 r/min. As the result, wearing caused by slipping between the slipper and the slant plate was hardly observed, and was a very small value (0 to 2 $\mu$m) not becoming a problem as the pump.

Next, the wear resistance in the spherical sheet portions of the slipper 10 and the plunger 11 was evaluated. As the result, wear was caused in the slipper sphere side due to slipping with the plunger (nitrided SKD11), and remarkable difference appeared among the materials.

Figure 18:
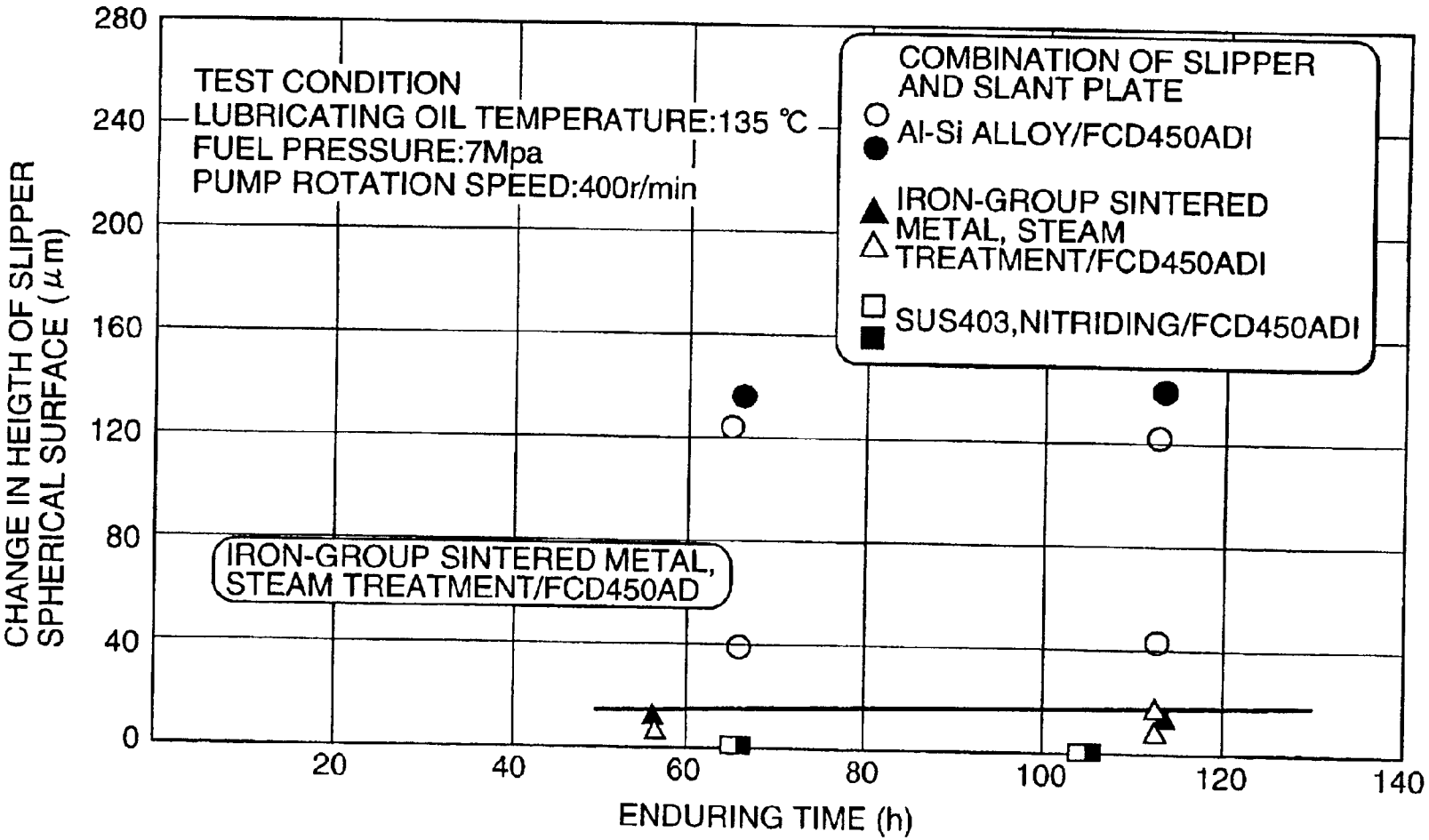
FIG. 18 is a graph showing the wear in the slipper spherical surface obtained from a wearing test.

FIG. 18 is a graph showing the relationship between the change (amount of wear) in the height of the slipper spherical surface and the enduring time, and shows the wearing test results using the actual pump obtained by combining the nitrided material of SUS403, the Al—Si alloy, the iron group sintered material (with the oxide film) for the slipper and the FCD450ADI for the slant plate. It can be understood from the relationship between the amount of wear in the slipper spherical surface for each of the material and the enduring time that there exist remarkable differences among the materials. That is, the amount of wear for the Al—Si alloy is as large as 40 to 140 $\mu$m, and the amounts of wear for the iron group sintered material and for the nitrided material of SUS403 are small. The reason why the amount of wear of the spherical surface side of the Al—Si alloy is large is that since the spherical surface side slides in line contact on the hard nitrided SKD11 material of the plunger, the wear causes on the soft Al—Si alloy. At that time, hard lumps of initial crystal Si and very small particles of eutectic Si become abrasive powder to accelerate abrasive wear. It is important to reduce the amount of the abrasive wear, and in order to do so, it is necessary to increase the hardness of the slipper material. The evaluation results of FIG. 18 also show the above fact.

As a factor influencing on the wear resistance in sliding of the spherical sheet portions of the slipper 10 and the plunger 11, there is temperature of the environment, that is, temperature of the lubricating oil of engine oil. A warranted temperature of engine oil in an actual pump is 140° C. However, by taking a safety factor into consideration, it is necessary to maintain the wear resistance in a temperature range above the warranted temperature. Therefore, using the slippers made of the iron group sintered material (with the oxide film) and made of the nitrided material of SUS403 which had have good wear resistance in the material combination of the actual pump test on the on-bench engine, the effect of engine oil temperature on the wear resistance was evaluated through component wear tests.

The test was performed using a wear tester of Matsubara's type by setting a slipper to a rotating side jig and a plunger to a fixed jig in an enclosed container, and adding a load to the fixed jig. The test atmosphere was set to a nitrogen gas environment, and the pressure was controlled to 3.5 MPa. The test conditions were slipper rotating speeds of 15 and 60 r/min, testing time of 120 min, load of 1.08 kN, and lubricating oil temperature was varied from 30 to 160° C.

Figure 19:
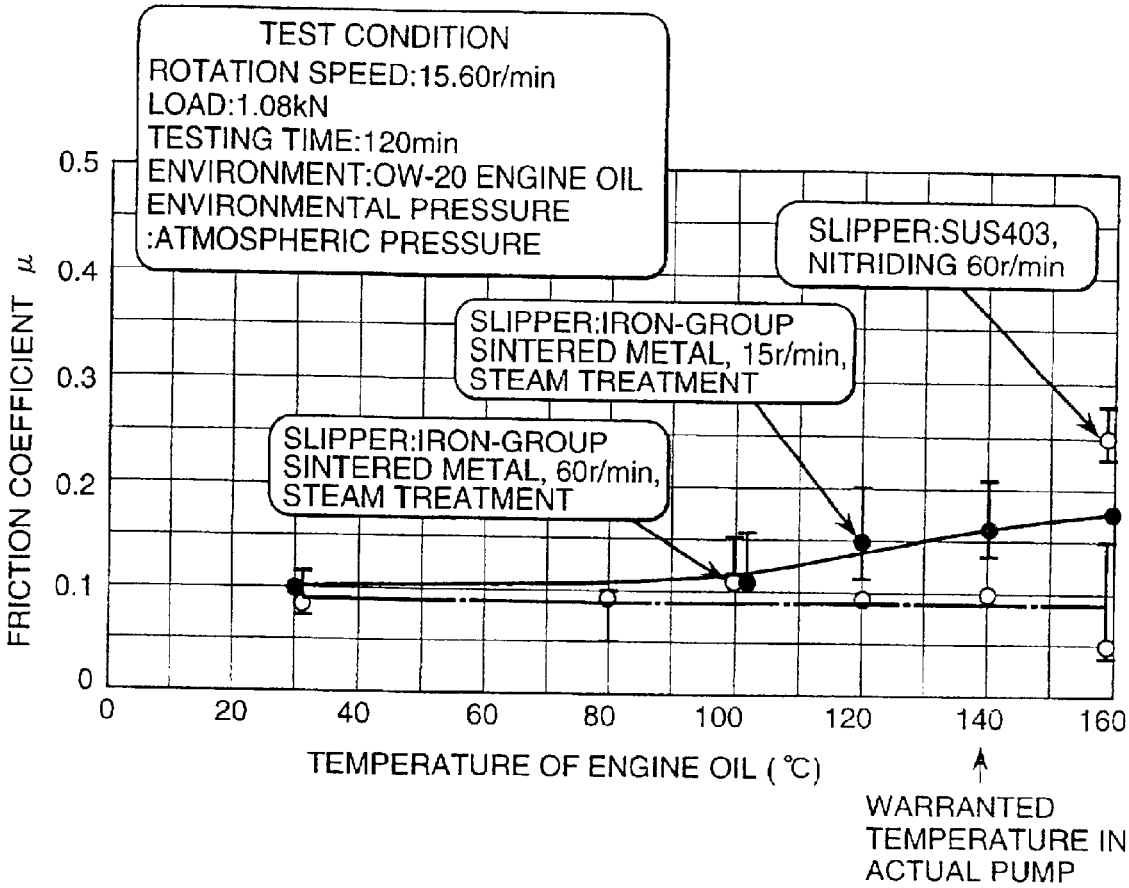
FIG. 19 is a graph showing the relationship between friction coefficient and temperature of engine oil when the slipper and the plunger slip on each other.

FIG. 19 is a graph showing the effect of engine oil temperature on the friction coefficient between the plunger made of nitrided material of SKD11 and the slippers made of the iron group sintered material (with the oxide film) and made of nitrided material of SUS403. In the case of the slipper made of nitrided material of SUS403, the effect of engine oil temperature on the friction coefficient increases as the oil temperature is increased. On the other hand, in the case of the slipper made of the iron group sintered material (with the oxide film), the friction coefficient does not change and keeps a constant value of nearly 0.1 even if the oil temperature is increased.

Figure 20:
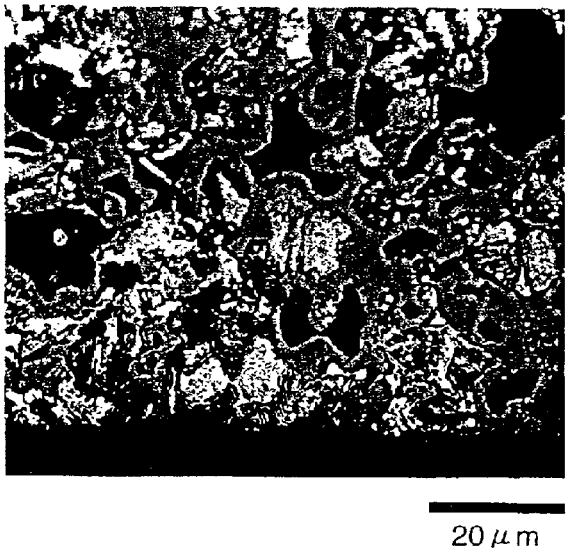
FIG. 20 is a microscopic photograph showing the section of the slipper used in the present embodiment.

FIG. 20 shows an example of a cross-sectional structure of the slipper made of the iron group sintered material (with the oxide film) used in the present invention. The gray-colored oxide film is formed on the surface and on the base material surface in contact with holes in the inside, and the base material is of the pearlite structure. The reason why the friction coefficient of the iron group sintered material (with the oxide film) is small and does not largely change when the oil temperature rises is considered that the friction force is reduced by existing of the oxide film formed through the steam treatment, and that the lubrication effect supplementing decrease of oil film in the friction surface due to temperature rise by the oil retaining effect of the holes specific to the sintered material. On the other hand, in the case of the nitrided material of SUS403, the friction force is increased because both of the friction surfaces are smooth surfaces, and accordingly there is no lubrication effect described above. As shown in the figure, there were 5 holes having size of 5 to 20 μm within a field of view of 100 μm×70 μm.

From the results described above, it was known that the slipper made of the iron group sintered material (with the oxide film) was more stable than the slipper made of the nitrided material of SUS403 up to the high temperature range of the engine oil. Therefore, the suitable material for the slipper is the iron group sintered material (with the oxide film) which is good in wear resistance up to the high lubricating oil temperature range above the warranted oil temperature of actual pump. Further, the iron group sintered material is preferable from the viewpoint of productivity since the iron group sintered material is good in productivity and low in cost.

On the other hand, the FCD450ADI is used for the slant plate. The other materials applicable to the slant plate are the mechanical structural alloy steels and the surface treated materials of the mechanical structural alloy steels. For example, as the surface treated materials of the mechanical structural alloy steels, the carburization quenched material of the chromium-molybdenum steel SCM415, the nitrided material of the chromium-molybdenum steel SCM435 and so on are used. Thus, the specification for the materials satisfying the seizing resistance between the slant plate 9 and the slipper 10 under the high peripheral speed sliding condition and the wear resistance in the sliding between the spherical sheet portions of the slipper 10 and the plunger 11 required as the fuel pump has been found.

Next, as the main members which are operated and slid in the fuel, and are required corrosion resistance and wear resistance, there are the plunger of the pressurizing member of the pump chamber and the cylinder bore of the cylinder having the sliding bore for reciprocally and slidably supporting the plunger. Particularly, the radial gap between the plunger and the cylinder is designed to be smaller than 10 μm because of minimizing the fuel leakage from the pressurizing chamber. Therefore, if the radial gap is increased due to wear, the pump performance will be decreased.

Further, the plunger is required to be corrosion resistant and wear resistant in the sliding portion with the shaft seal for sealing the fuel and the oil. The wear in the sliding portion is undesirable because if the fuel leaks to the oil, the oil is diluted to deteriorate the lubrication performance and also to degrade the fuel economy.

Therefore, the material structures of the plunger and the cylinder block are determined as follows. Since the outer radial portion of the plunger initially slides on the cylinder bore under a line contact condition, the outer radial portion of the plunger receives a high surface pressing pressure (Hertz stress). Therefore, the material is preferably of high hardness. As the materials used for the cylinder block, quenched-and-tempered martensitic stainless steel of SUS440C or SUS420J2 is used. The martensitic stainless steel is good in productivity because it can be formed into the product-shape through pressing work. Further, the alloy tool steels such as the quenched-and-tempered material of SKD61, the quenched-and-tempered material of SKD11 and so on are also usable. The materials SUS440C and SUS420J2 are hardened to Hv 500 to 700 by quenching and tempering. Further, the materials SUS440C and SUS420J2 are good in corrosion resistance because of stainless steels.

However, if the sliding condition between the cylinder block becomes severer due to the combination with a kind of the material of the plunger, an abnormal wear may occur between the plunger and the cylinder bore due to insufficiency of hardness of the above-mentioned base material of the cylinder block. Therefore, in order to improve the wear resistance of the cylinder block by further hardening the hardness of the above-mentioned base material, the material of the cylinder block is surface treated. The same can be said to the material of the plunger. Since the plunger is exposed to a surface pressing pressure higher than that of the cylinder block, the material of the plunger is surface treated in order to improve the wear resistance by further hardening the hardness.

In the present embodiment, each of the surface structures of the cylinder bore of the cylinder block and the plunger is that a diffusion surface treated layer is formed in the base material.

In regard to the surface treatment, the ion nitriding treatment is unsuitable for forming a uniform nitrided layer in the cylinder bore because the regions not producing glow discharge exist in a narrow portion. Therefore, the low temperature nitriding treatment using a salt-bath was applied to nitrided-layer forming of the diffusion surface treated layer of the cylinder bore.

That is, the nitriding treatment not deteriorating corrosion resistance (hereinafter, referred to as the low temperature nitriding treatment) was applied to the nitrided-layer forming of the diffusion surface treated layer. Forming of the nitrided layer at a temperature below 450° C. forms S-phase, and prevents Cr in the base material from forming nitride. As the method of forming the nitrided layer at low temperature, there is a treating method using gas or using a salt bath. However, the nitrided layer formed through the treating method has a thin treated depth because the nitriding temperature is low. Therefore, the nitriding method described above is unsuitable for forming the nitrided layer in a sliding mechanism portion to which a high load (stress) is applied.

Figure 21:
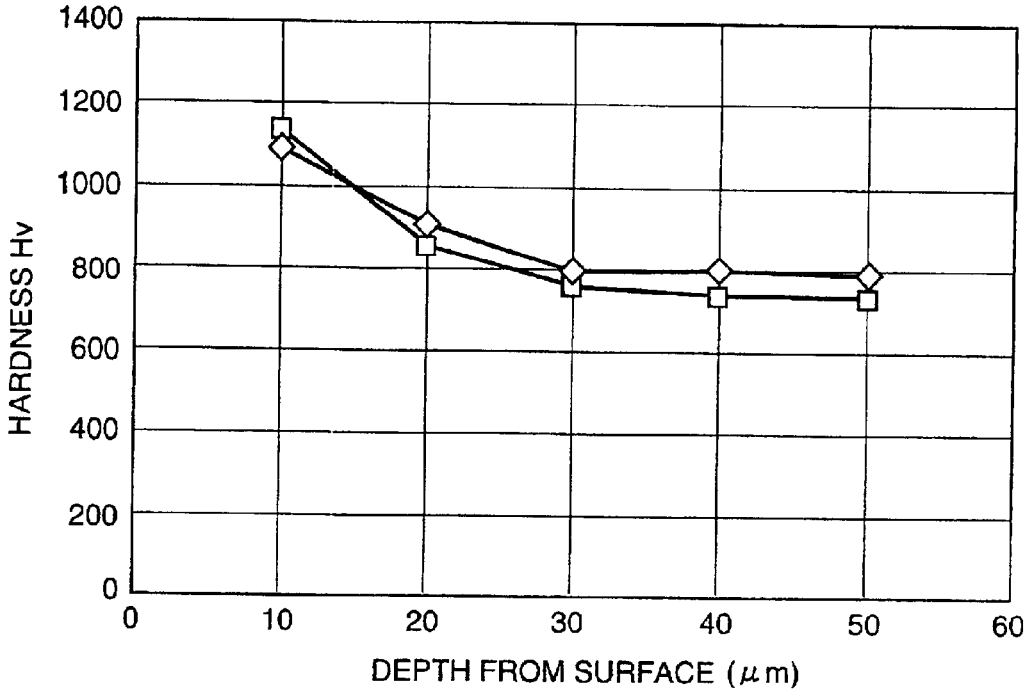
FIG. 21 is a graph showing the hardness distribution in the nitride layer of the alloy tool steel in accordance with the present invention.

FIG. 21 is a graph showing the hardness distribution of the cylinder bore portion of a cylinder block made of the alloy tool steel (7% Cr—Mo—V steel) which is low-temperature nitriding treated using the salt bath. The treating condition is treating temperature of 450° C. and treating time of 2 hours. The nitrided layer formed has a high hardness value of about Hv 1200 at a position of 10 μm from the surface and a total hardened depth of about 0.03 mm. No ε-phase of Fe nitride called as the brittle white compound is formed on the surface. Therefore, the wear resistance at sliding on the plunger can be secured.

The corrosion resistance has been shown in FIG. 6. Both of the natural potential and the pitting corrosion potential of the low-temperature nitriding treated SKD11 and SUS420J2 materials are nobler potentials compared to those of the other comparative materials or the general nitrided materials. Therefore, the low-temperature nitriding treated SKD11 and SUS420J2 materials are good in corrosion resistance.

An endurance test was conducted using the actual slant-plate type axial plunger pump of FIG. 13 having the construction described above. As the result, the pump was operated without any abnormality, and the performance of gasoline delivery flow rate was also stable. After the endurance test, the pump was disassembled to inspect the components in the fuel chamber. As the inspection result, each of the components was in a normal wear condition without any abnormal wear.

It can be understood from the above-mentioned results that in the pump constructed of the slant plate made of the casting iron; the slipper made of the iron group sintered material (with the oxide film); the plunger made of the nitrided SKD11 material; and the cylinder made of the low-temperature nitrided alloy tool steel of the present embodiment, sticking between the sliding parts hardly occurs, and the wearing resistance is improved. By these good characteristics, the wearing resistance under the severe environment is improved, and accordingly the targeted fuel pump can be obtained.

Embodiment 4

Figure 22:
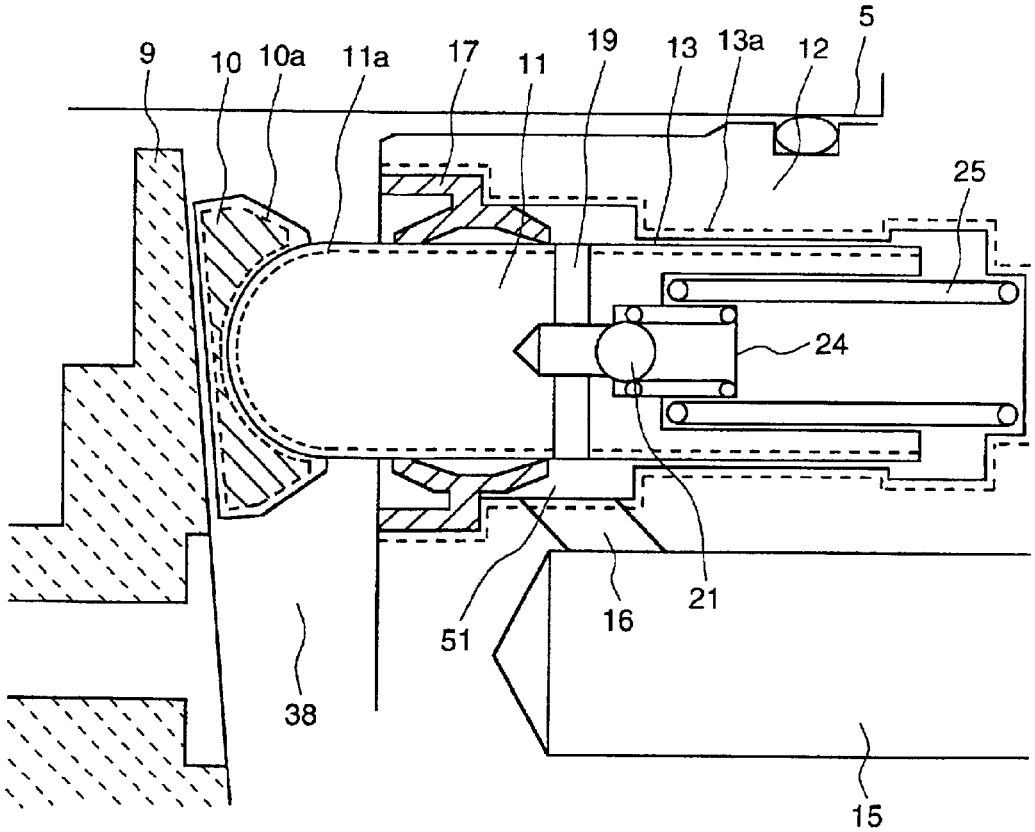
FIG. 22 is an enlarged partial view showing the surface treated layer of the plunger of FIG. 13 in accordance with the embodiment 4.

FIG. 22 is an enlarged cross-sectional view showing the details of a part of the fuel pump shown in FIG. 13. Description will be made on another embodiment in which corrosion resistance and wear resistance of the sliding mechanism portions in the slant plate type axial plunger high pressure pump of FIG. 13 are required to be further improved. Gasoline flows through in order of the suction space 15, the communicating passage A 16, the backfacing 51 provided in the cylinder 12, and then the communicating passage A 16, the inlet hole 19, the suction valve toward the inside of the plunger 11, in this order, to be pressurized. Therein, the seal 17 arranged in the cylinder 12 seal the fuel from the oil when the plunger 11 is reciprocally moved. The present embodiment copes with the wearing of the seal 17 (an elastic body, for example, a rubber member) and the plunger, and the wearing of the plunger 11 and the cylinder bore 13. As the sliding mechanism portion required to be corrosion resistant and wear resistant, a corrosion resistant and wear resistant hard film 11*a* was formed on the topmost surface of the plunger 11. In order to form the corrosion resistant and wear resistant hard film, the physical vapor deposition method capable of forming a fine coating film having highly adhesive force under a low temperature range such as the ion plating method can be employed. The method is not limited to the above. For example, the arc ion plating method, the hollow cathode method, the arc discharge method or the sputtering method may be employed. The material of the coating film is selected from TiC, WC, SiC as carbides, TiN, CrN, BN, TiAlN as nitrides, TiCN as carbonitrides, and so on depending on the purpose.

From the corrosion resistance of the corrosion resistant and wear resistant hard film in FIG. 6, both of the natural potential and the pitting corrosion potential of the hard films are nobler potentials. Therefore, the hard films are good in corrosion resistance. The hard film has an effect to suppress the metal transfer bonding phenomenon caused between the hard film and another material and to prevent sticking and seizing phenomenon, and has a small friction coefficient to prevent initial wear, normal wear and seizing. Accordingly, the effect of corrosion wear was small. Thereby, the components can be operated as the sliding members in the fuel under the severe corrosion environment.

In the present embodiment, a corrosion resistant and wear resistant hard film was formed on the surface treated layer 11*a* of the plunger 11. The alloy tool steel SKD11 was selected as the base material, and the hard film of 3 $\mu$m thick was formed on the surface. The other sliding portions were the same as those in the first embodiment. An endurance test was conducted using the actual slant-plate type axial plunger pump of FIG. 13 having the construction described above. As the result, the pump was operated without any abnormality, and the performance of gasoline delivery flow rate was also stable. After the endurance test, the pump was disassembled to inspect the components in the fuel chamber. As the inspection result, each of the components was in a normal wear condition without any abnormal wear. On the other hand, in the pump using untreated components, a little amount of wear was observed in the outer surface of the plunger 11 and in the sliding portion of the seal 17.

From the results described above, in the pump constructed in the present embodiment, sticking between the sliding portions hardly occurred, and the wear resistance was improved. Since the surface treated layer of the plunger is composed of the corrosion resistant and wear resistant film and the diffusion surface treated layer, the plunger has characteristics that flaking hardly occurs even under high surface pressing pressure, and the corrosion resistance is good. By these good characteristics, the wearing resistance under the severe environment is improved, and accordingly the targeted fuel pump can be obtained.

Embodiment 5

Figure 23:
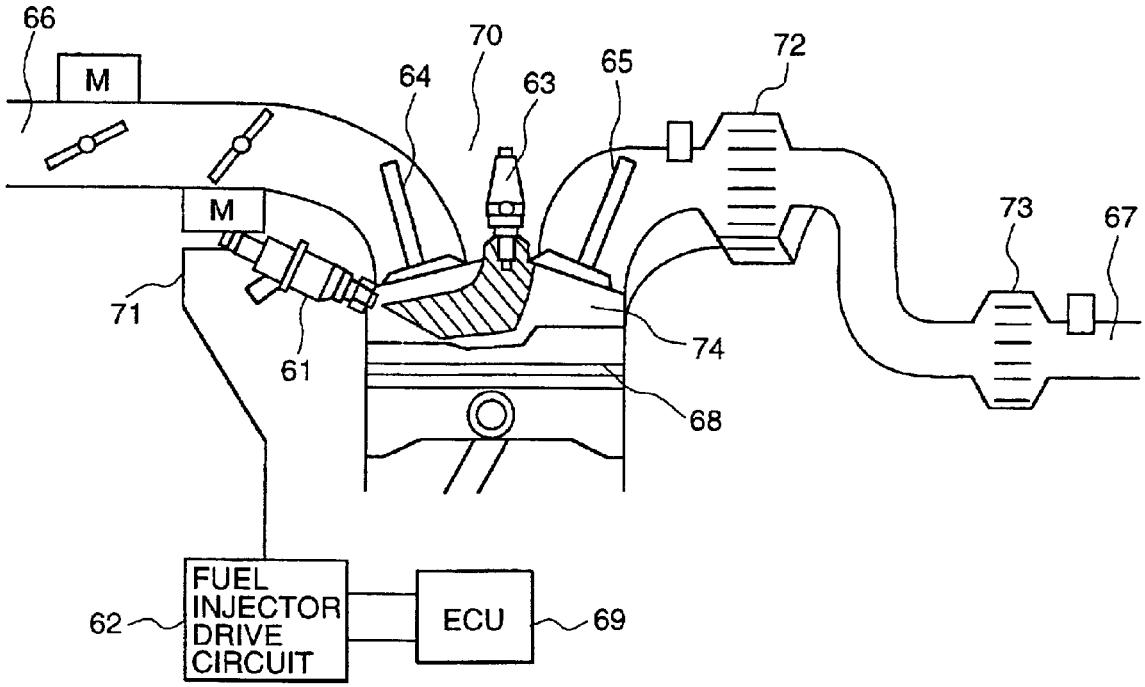
FIG. 23 is a view showing the construction of an embodiment of a direct injection gasoline engine in accordance with the present invention.

FIG. 23 is a cross-sectional view showing an embodiment of an internal combustion engine of a gasoline in-cylinder direct fuel injection type for vehicle which uses the fuel pump according to any one of the embodiment 1 to 4. An end portion of a fuel injector 61 provided in a cylinder head 70 is opened to a combustion chamber 74 so that fuel supplied from a fuel gallery can be directly injected into the combustion chamber 74. In the present embodiment, the engine comprises the high pressure fuel pump for supplying fuel to the fuel injector 61 in order to atomize gasoline to be burned in an ultra lean burn condition and directly inject the fuel into the engine cylinder.

A spark plug 63 is arranged between an intake valve 64 and an exhaust valve 65, and a mixture of intake air sucked through an intake air port 66 by movement of a flat piston 68 during opening the intake valve 64 and fuel injected from the injector 61 is started to be burned by ignition caused by electric spark. The gas after combustion is discharged through the exhaust valve 65 by movement of the piston 68 during opening the exhaust valve 65.

A fuel injector driving circuit 62 is electrically connected to an injector driving signal terminal 71 of the fuel injector 61. Further, an electronic control unit (ECU) 69 for outputting a fuel injector driving trigger signal and a signal for determining whether or not the fuel injector is driven so as to shorten operation lag of the valve body is electrically connected to the fuel injector driving circuit 62. Operational states of the engine are input to the electronic control unit 69, and the fuel injector driving trigger signal is determined corresponding to the operational states.

The amount of air supplied through the intake port 66 is controlled by two magnetic means M moved by being interlocked with an accelerator. Hydrocarbons, carbon monoxide and NOx are removed from the exhaust gas after combustion using a ternary catalyst of a low oxygen storage type 72, and NOx is further removed a lean NOx catalyst 73. In the present embodiment, the fuel from the fuel injector 61 is atomized to ultra-fine droplets having a diameter below 25 $\mu$m, preferably below 15 $\mu$m, particularly preferably 10 $\mu$m to be injected into the engine cylinder, and the engine is operated under an ultra-lean-burn condition of air-fuel ratio of 50.

A catalyst having Pt or Pt and Ce on an alumina carrier is used as the ternary catalyst 72, and a catalyst having Pt or Pt and oxides of Na and Ti on an alumina carrier is used as the NOx catalyst 73.

The total structure of the fuel injector 61 is as follows. It is mounted on the cylinder head 70. That is, the fuel injector 61 is fixed to a housing, and comprises a core, a coil assembly, an armature and a swirler valve unit which is supported by one end of the housing with caulking. Further, the valve unit comprises a stepped hollow cylindrical valve main body having a smaller diameter cylindrical portion and a larger diameter cylindrical portion; a valve sheet having a fuel injection hole, the valve sheet is fixed to a center hole chip inside the valve main body; and a needle valve of a valve for opening and closing the fuel injection hole by contacting with and detaching from the valve sheet driven by a solenoid device. There are two O-rings arranged in the fuel pressure applied side in contact with the bottom surface of the coil assembly and inside a space surrounding the housing and the core. The diameter of the fuel injection hole is 0.8 mm.

The operation of the fuel injector will be described below. When the coil is energized, a magnetic flux is generated in the magnetic circuit composed of the armature, the core and the housing to attract the armature toward the core side. Then, when the needle valve integrated with the armature into a single body is detached from the valve sheet to form a gap, the high pressure fuel enters into the injection hole of the valve sheet to be atomized into ultra-fine droplets and sprayed through the chip end outlet of the injection hole.

Further, the fuel injector 61 is projected toward the inside of the cylinder head by 2 to 10 mm.

Particularly, the valve main body, the valve sheet, the needle valve and the swirler are manufactured by performing cold plastic work of 1% C—16% Cr ferritic stainless steel of JIS standard type SUS44C, and annealing the workpiece, and then machining the workpiece into the final shape. The diameter of the fuel injection hole is 0.8 mm, and the circularity of the inner diameter is below 0.5 $\mu$m.

Description will be made below on a method of forming an organic coating film on the chip end portion of the fuel injector 6, and on the effect of the organic coating film. The present embodiment is a fuel injector having an organic coating film of 1.5 to 8 nm thick the fuel injection hole and its vicinity or having an organic coating film on the surface of the fuel injection hole. The fuel injector can be obtained by satisfying one or combination of two or more of the following requirements that the injection hole has a bore capable of atomizing the fuel to droplets having a diameter below 20 $\mu$m; that the bore of the injection hole described above is with in a range of 0.3 to 0.8 mm; and that the injection hole and the vicinity described above are made of a ferritic stainless steel containing C of 0.6 to 1.5%, Si below 1%, Mn below 1.5% and Cr of 15 to 20% on a weight basis.

The organic coating film is bonded by covalent bond with the base metal, and the thickness is preferably 1.5 to 30 nm, particularly preferably 1.5 to 10 nm, and the best thickness is 1.5 to 7 nm.

As the usable organic films, there are films which are formed under glow discharge of perfluoropolyether compound, tetrafluoroethylene monomer, silicone resin, polyamide resin and so on, and obtained by a solution of Teflon resin, metallic alkoxide and fluoroalkyl group substituent alkoxide.

The present embodiment is a direct fuel injection engine comprising a cylinder head having an intake means and an exhaust means in a combustion chamber; a piston reciprocally moving inside the cylinder head; a fuel injection means arranged so that fuel can be injected into the combustion chamber; and an ignition means for igniting the fuel injected from the fuel injection means, wherein the above-described fuel pump and the above-described fuel injector can be used.

Further, the present embodiment is a direct fuel injection engine comprising a cylinder head having an intake means and an exhaust means in a combustion chamber; a piston reciprocally moving inside the cylinder head; a fuel injection means arranged so that fuel can be injected into the combustion chamber with lean-burn controlling of air-fuel ratio above 45; and an ignition means for igniting the fuel injected from the fuel injection means, wherein the above-described fuel injection means has an organic coated film on the surface of the injection hole for spraying the fuel and the vicinity of the injection hole, and the above-described fuel pump is used.

According to the present embodiment, it is possible to prevent deposits produced by burning of gasoline from attaching onto the surface of the fuel injector of the direct injection engine, and particularly it is possible to perform the ultra-lean burn control of the air-fuel ratio above 45, and accordingly it is possible to attain a high fuel economical vehicle.

According to the present invention, there is a remarkable effect of preventing occurrence of seizing and abnormal wear in the fuel pump by combining material constructions of the sliding components in fuel, particularly, in the component sliding with the plunger, and by forming the seizing resistant, wear resistant and corrosion resistant coating film on each of the sliding mechanism components. Therefore, the high reliable high-pressure fuel pump can be provided, and the remarkable effect can be obtained in the in-cylinder direct fuel injection of the lean-burn engine for vehicle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fuel pump for pressurizing fuel to deliver the fuel to a fuel injector of a vehicle engine, which comprises:

a base member;

a hardened layer formed on the base member and composed of at least one layer selected from the group consisting of a nitrided layer, a carburization-quenched layer and a carbonitrided layer; and a carbon film having a hardness higher than a hardness of said hardened layer on a surface of said hardened layer and being provided on at least one of sliding and contacting surfaces which slide on each other through lubricating oil or fuel.

2. A fuel pump for pressurizing fuel to deliver the fuel to a fuel injector of a vehicle engine, which comprises:

a base member;

a hardened layer formed on the base member and composed of at least one layer selected from the group consisting of a nitrided layer, a carburization-quenched layer and a carbonitrided layer on one of sliding surfaces which contact with and slide on each other through said fuel or lubricating oil;

a hardened layer composed of at least one layer selected from the group consisting of a nitrided layer, a carburization-quenched layer and a carbonitrided layer on the other sliding surface opposite to said one of the sliding surfaces; and a carbon film having a hardness higher than a hardness of said hardened layer on each of surfaces of said hardened layers of said one sliding surface and the other sliding surface.

3. A fuel pump comprising a shaft rotated by driving of a vehicle engine; a cam rotated by the rotation of said shaft; and a plunger reciprocally moved in a cylinder by the rotation motion of said cam through a lifter, said fuel pump pressurizing fuel to deliver the fuel to a fuel injector of the vehicle engine, which comprises:

a base member;

a hardened layer formed on the base member and composed of at least one layer selected from the group consisting of a nitrided layer, a carburization-quenched layer and a carbonitrided layer on at least one of sliding surfaces of said plunger and said cylinder which contact with and slide on each other; and a carbon film having a corrosion resistance to said fuel higher than a corrosion resistance of said hardened layer, said carbon film being formed on a surface of said hardened layer.

4. A fuel pump comprising a shaft rotated by driving of a vehicle engine; a cam rotated by the rotation of said shaft; and a plunger reciprocally moved in a cylinder by the rotation motion of said cam through a lifter, said fuel pump pressurizing fuel to deliver the fuel to a fuel injector of the vehicle engine, which comprises:

a base member;

a hardened layer formed on the base member and composed of at least one layer selected from the group consisting of a nitrided layer, a carburization-quenched layer and a carbonitrided layer on a sliding surface of said lifter contacting with and sliding on said cam through lubricating oil; and a carbon film having a hardness higher than a hardness of said hardened layer, said carbon film being formed on a surface of said hardened layer.

5. A fuel pump comprising a shaft for transmitting rotation from outside; a slant plate for converting the rotation of said shaft to oscillating motion; and a plunger for converting the oscillating motion of said slant plate to reciprocal motion in a cylinder through a slipper, wherein said slipper is made of an iron group sintered material, and an oxide layer is formed on a surface of said slipper.

6. A fuel pump comprising a shaft for transmitting rotation from outside; a slant plate for converting the rotation of said shaft to oscillating motion; and a plunger for converting the oscillating motion of said slant plate to reciprocal motion in a cylinder through a slipper, wherein said slipper is made of an iron group sintered material, an oxide layer being formed on a surface of said slipper, a hardened layer composed of at least one layer selected from the group consisting of a nitrided layer, a carburization-quenched layer and a carbonitrided layer being formed on an inner peripheral surface of said cylinder and an outer peripheral surface of said plunger.

7. A fuel pump comprising a shaft for transmitting rotation from outside; a slant plate for converting the rotation of said shaft to oscillating motion; and a plunger for converting the oscillating motion of said slant plate to reciprocal motion in a cylinder through a slipper, wherein a hardened layer composed of at least one layer selected from the group consisting of a nitrided layer, a carburization-quenched layer and a carbonitrided layer is formed on an inner peripheral surface of said cylinder, and a carbon film is formed on an outer peripheral surface of said plunger.

8. A fuel pump comprising a shaft for transmitting rotation from outside; a slant plate for converting the rotation of said shaft to oscillating motion; and a plunger for converting the oscillating motion of said slant plate to reciprocal motion in a cylinder through a slipper, wherein said slipper is made of an iron group sintered material, an oxide layer being formed on a surface of said slipper, a hardened layer composed of at least one layer selected from the group consisting of a nitrided layer, a carburization-quenched layer and a carbonitrided layer being formed on an inner peripheral surface of said cylinder, a carbon film being formed on an outer peripheral surface of said plunger.

9. A fuel pump for pressurizing fuel to deliver the fuel to a fuel injector of a vehicle engine, which comprises:

a hardened layer composed of at least one layer selected from the group consisting of a nitrided layer, a carburization-quenched layer and a carbonitrided layer on an inner peripheral surface of a cylinder to serve as a sliding surface of one member; and a carbon film layer on an outer peripheral surface to serve as a sliding surface of the other member, said sliding surfaces contacting with and sliding on each other through lubricating oil or said fuel, wherein another member sliding on an end surface of said the other member is formed of an iron group sintered material, and an oxide layer is formed on a surface of said another member.

10. A direct fuel injection engine comprising a cylinder; a piston reciprocally moving in said cylinder; a fuel injection means for directly injecting fuel into said cylinder; and a fuel pump for delivering said fuel to said fuel injection means, wherein said fuel pump is any one of the pumps described in claim 1.

11. A direct fuel injection engine according to claim 10, wherein said fuel injection means injects said fuel according to control of a lean-burn condition of an air-fuel ratio above 45.

12. The fuel pump according to claim 1, wherein the carbon film is diamond-like carbon.

13. The fuel pump according to claim 2, wherein the carbon film is diamond-like carbon.

14. The fuel pump according to claim 3, wherein the carbon film is diamond-like carbon.

15. The fuel pump according to claim 4, wherein the carbon film is diamond-like carbon.

16. A fuel pump for pressuring fuel to deliver the fuel to a fuel injector of a vehicle engine according to any one of claim 1, 2, or 9 wherein the carbon film has a thickness of less than 1.5 $\mu$m.

17. A fuel pump according to any one of claim 3, 4, 7, or 9, wherein the carbon film has a thickness of less than 1.5 $\mu$m.

18. A fuel pump according to any of claim 12, 13, 14 or 15, wherein the carbon film has a thickness of less than 1.5 $\mu$m.

19. A fuel pump for pressuring fuel to deliver the fuel to a fuel injector of a vehicle engine according to claim 1 or 2, wherein the outermost surface layer comprises a covering filling consisting of carbon.

20. A fuel pump according to any one of claim 3, 4, 7, or 8, wherein the outermost surface layer comprises of a covering filling consisting of carbon.

21. A fuel pump according to any one of claim 12, 13, 14, or claim 15, wherein the outermost surface layer comprises of a covering filling consisting of carbon.

* * * * *